US007736155B2

(12) United States Patent
Kimura

(10) Patent No.: US 7,736,155 B2
(45) Date of Patent: Jun. 15, 2010

(54) CONNECTOR

(75) Inventor: Masaki Kimura, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/244,025

(22) Filed: Oct. 2, 2008

(65) Prior Publication Data

US 2009/0098757 A1 Apr. 16, 2009

(30) Foreign Application Priority Data

Oct. 11, 2007 (JP) ..... 2007-265940

(51) Int. Cl.
*H01R 12/00* (2006.01)

(52) U.S. Cl. ..... 439/74; 439/660

(58) Field of Classification Search ..... 439/660, 439/74

See application file for complete search history.

(56) References Cited

U.S. PATENT DOCUMENTS 5,931,689 A * 8/1999 Patel ..... 439/346
2004/0157478 A1* 8/2004 Midorikawa et al. ..... 439/74
2005/0026466 A1* 2/2005 Kubo ..... 439/74

FOREIGN PATENT DOCUMENTS

JP 2005-71769 A 3/2005

* cited by examiner

*Primary Examiner*—Ross N Gushi
(74) *Attorney, Agent, or Firm*—Frishauf, Holtz, Goodman & Chick, P.C.

(57) ABSTRACT

A connector capable of ensuring reliability of contact even when a mating object to be connected, which is fitted to a receiving portion of a housing, is tilted. The receiving portion for receiving a plug-side connector is formed in the housing. A plurality of first socket-side contacts including contact portions are arranged in the housing. Each contact portion protruding into the receiving portion can be brought into contact with a first plug-side contact of the plug-side connector. A plurality of second socket-side contacts including contact portions are arranged in the housing. Each contact portion protruding into the receiving portion can be brought into contact with a second plug-side contact of the plug-side connector. Protruding portions are formed in the housing, for suppressing displacement of the plug-side connector in the receiving portion.

6 Claims, 28 Drawing Sheets

*FIG. 11*
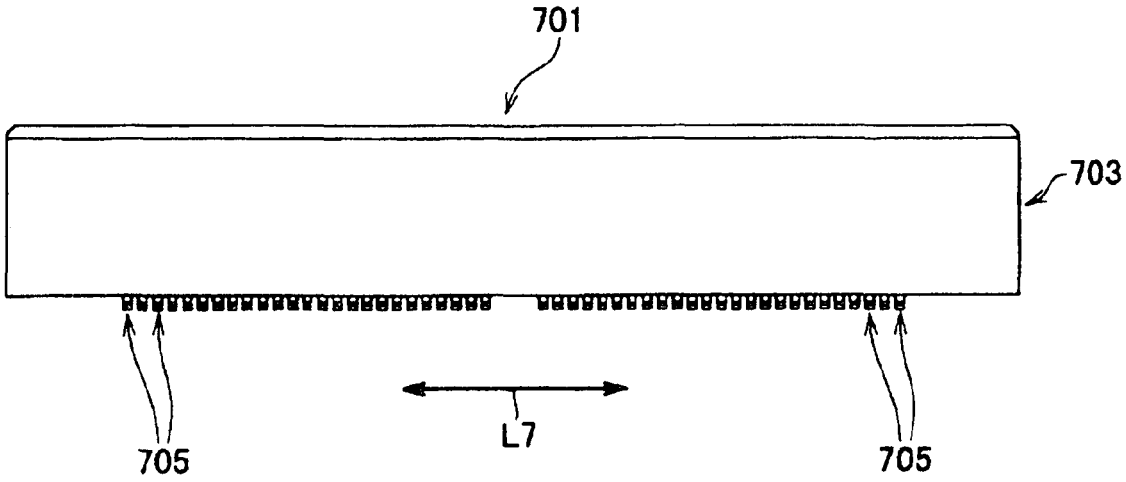
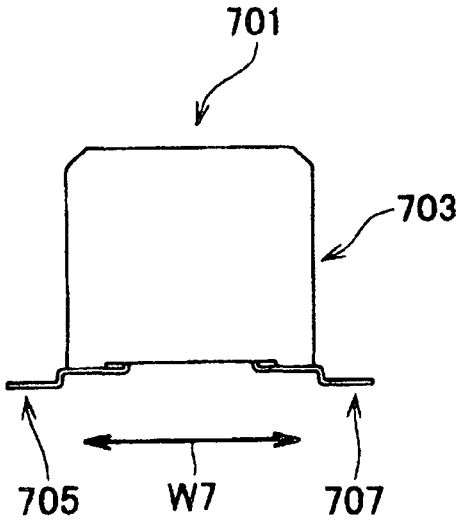
*FIG. 12*

*FIG.22*
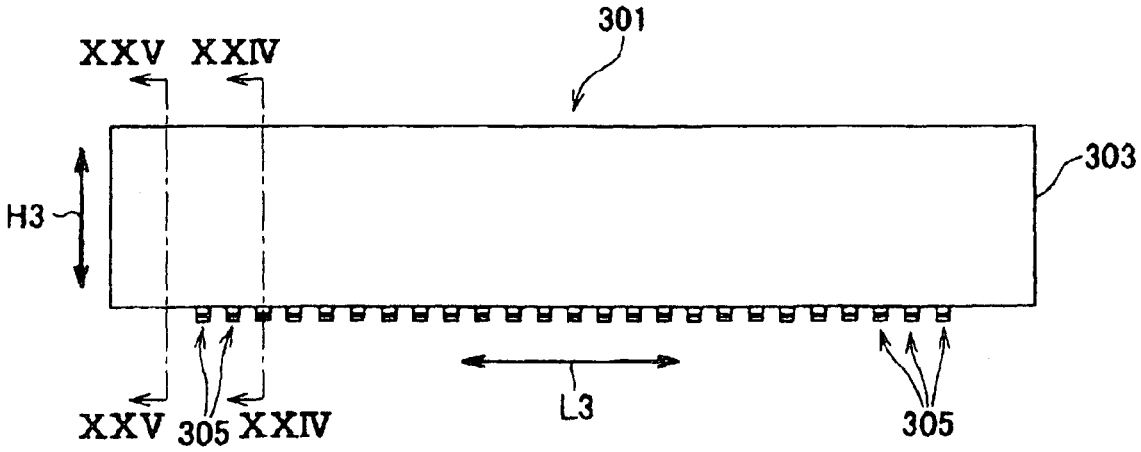
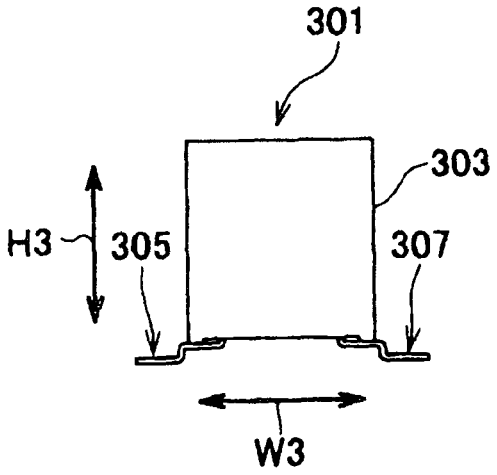
*FIG.23*

CONNECTOR

BACKGROUND OF THE INVENTION

1. Field of the Invention

This invention relates to a connector.

2. Description of the Related Art

Conventionally, there has been proposed a connector comprised of a receptacle connector and a plug connector (see Japanese Laid-Open Patent Publication (Kokai) No. 2005-71769).

The receptacle connector is comprised of a receptacle-side housing including a receiving portion for receiving the plug connector, and a plurality of receptacle-side contacts each held by a corresponding one of two side walls of the receptacle-side housing, opposed to each other via the receiving portion.

Each receptacle-side contact includes a receptacle-side contact portion that is capable of being brought into contact with a plug-side contact portion of the plug connector. The receptacle-side contact portion faces the receiving portion.

The plug connector is comprised of a plug-side housing including a protrusion that is capable of being fitted in the receiving portion of the receptacle connector, and a plurality of plug-side contacts each held by a corresponding one of opposite surfaces of the protrusion, respectively.

Each plug-side contact includes the plug-side contact portion that is capable of being brought into contact with the associated receptacle-side contact portion of the receptacle connector, and an elastically deformable plug-side spring portion for supporting the plug-side contact portion.

The plug-side contact portion and the plug-side spring portion are accommodated in a contact accommodating space formed in each of the opposite surfaces of the protrusion. Part of the plug-side contact portion protrudes from the contact accommodating space.

When the receptacle connector and the plug connector are fitted to each other, the plug-side contact portion of the plug-side contact and the receptacle-side contact portion of the receptacle-side contact are brought into contact with each other. At this time, the plug-side spring portion of the plug connector is elastically deformed, whereby the plug-side contact portion is withdrawn into the contact accommodating space against the spring force thereof. This generates a contact force between the receptacle-side contact portion and the plug-side contact portion, whereby the receptacle connector and the plug connector are electrically connected.

A gap between the receptacle-side housing and the plug-side housing formed when the receptacle connector and the plug connector are fitted to each other is small, and therefore when one of the housings is tilted with respect to the fitting direction after the receptacle connector and the plug connector are fitted, there is a fear that the housing is damaged. For example, when a notebook PC (Personal Computer) is connected to a docking station on a desk, a PC-side connector is fitted to a docking station-side connector with a fitting surface of the PC-side connector located at one end of the bottom surface of the notebook PC kept opposed to a fitting surface of the docking station-side connector. After the PC-side connector has been fitted, when the other end of the bottom surface of the notebook PC is placed on the desk, the PC-side connector is tilted with respect to the fitting direction.

To avoid this inconvenience, it is only required to increase the gap formed between the housings when the connectors are fitted.

However, if the gap is simply increased, when the connectors are fitted, the position of the plug-side housing within the receiving portion of the receptacle connector is displaced in a contact direction. Therefore, although the amount of deformation of the plug-side spring portion of a first plug-side contact, which is disposed on one surface (surface facing the resulting smaller gap) of the protrusion of the plug-side housing, becomes sufficiently large, the amount of deformation of the plug-side spring portion of a second plug-side contact, which is disposed on the other surface (surface facing the resulting larger gap) of the protrusion of the plug-side housing, becomes very small.

As a result, although a sufficient contact force is generated between the receptacle-side contact portion of a first receptacle-side contact, which is disposed on one side wall of the receptacle-side housing, and the plug-side contact portion of the first plug-side contact, which is disposed on one surface of the protrusion of the plug-side housing, only a very small contact force is generated (or no contact force is generated) between the receptacle-side contact portion of a second receptacle-side contact, which is disposed on the other side wall of the receptacle-side housing, and the plug-side contact portion of the second plug-side contact, which is disposed on the other surface of the protrusion of the plug-side housing.

SUMMARY OF THE INVENTION

The present invention has been made in view of these circumstances, and an object thereof is to provide a connector which is capable of ensuring reliability of contact even when a mating object to be connected, which is fitted to a receiving portion of a housing, is tilted.

To attain the above object, the present invention provides a connector comprising a housing including a receiving portion for receiving a mating object to be connected, a plurality of first contacts each of which includes a first contact portion protruding into the receiving portion such that the first contact portion is capable of being brought into contact with a first mating contact portion of the mating object to be connected, and a first spring portion that is elastically deformable and supports the first contact portion, the plurality of first contacts being arranged and held in the housing in a direction of length of the housing, a plurality of second contacts each of which includes a second contact portion protruding into the receiving portion such that the second contact portion is capable of being brought into contact with a second mating contact portion of the mating object to be connected, and a second spring portion that is elastically deformable and supports the second contact portion, the plurality of second contacts being arranged and held in the housing in the direction of the length of the housing, and displacement-suppressing means for suppressing displacement of the mating object to be connected, in a contact direction, when the receiving portion has received the mating object to be connected.

With the arrangement of the connector according to the first aspect of the present invention, the displacement-suppressing means is provided for suppressing displacement of the mating object to be connected in the contact direction when the receiving portion has received the mating object to be connected. Therefore, even if the mating object to be connected is tilted within the receiving portion, the position of the mating object in the contact direction is hardly displaced. Therefore, according to the present invention, it is possible to ensure reliability of contact even when a mating object to be connected, which is fitted to a receiving portion of a housing, is tilted.

Preferably, the housing includes a protrusion that extends in the direction of the length of the housing in a manner protruding into the receiving portion, for being fitted to the mating object to be connected, and the first contact portion and the first spring portion of each of the first contacts are arranged on one surface side of the protrusion, while the second contact portion and the second spring portion of each of the second contacts are arranged on the other surface side of the protrusion, the displacement-suppressing means being protruding portions formed on opposite surfaces of the protrusion in a manner protruding into the receiving portion.

Preferably, the first contact portion and the first spring portion of each of the first contacts are arranged on one inner surface of the housing in the contact direction, and the second contact portion and the second spring portion of each of the second contacts are arranged on the other inner surface of the housing, opposed to the one inner surface of the housing via the receiving portion, the displacement-suppressing means being protruding portions that are formed on both the inner surfaces of the housing in a manner protruding into the receiving portion.

Preferably, the first contact portion and the first spring portion of each of the first contacts are arranged on one inner surface of the housing in the contact direction, and the second contact portion and the second spring portion of each of the second contacts are arranged on the other inner surface of the housing, opposed to the one inner surface of the housing via the receiving portion, the displacement-suppressing means comprising a metal member including two protruding portions that are held in the housing and protrude into the receiving portion in a manner opposed to each other via the receiving portion in the contact direction.

More preferably, the plurality of first contacts and the plurality of second contacts are sandwiched by the protruding portions in the direction of the length of the housing.

The above and other objects, features and advantages of the present invention will become more apparent from the following detailed description taken in conjunction with the accompanying drawings.

BRIEF DESCRIPTION OF THE DRAWINGS

FIG. 11 is a front view of the FIG. 9 plug-side connector;

FIG. 12 is a side view of the FIG. 9 plug-side connector;

FIG. 22 is a front view of the FIG. 20 card edge connector;

FIG. 23 is a side view of the FIG. 20 card edge connector;

DETAILED DESCRIPTION OF THE PREFERRED EMBODIMENTS

The present invention will now be described in detail with reference to the drawings showing preferred embodiments thereof.

Figure 1:
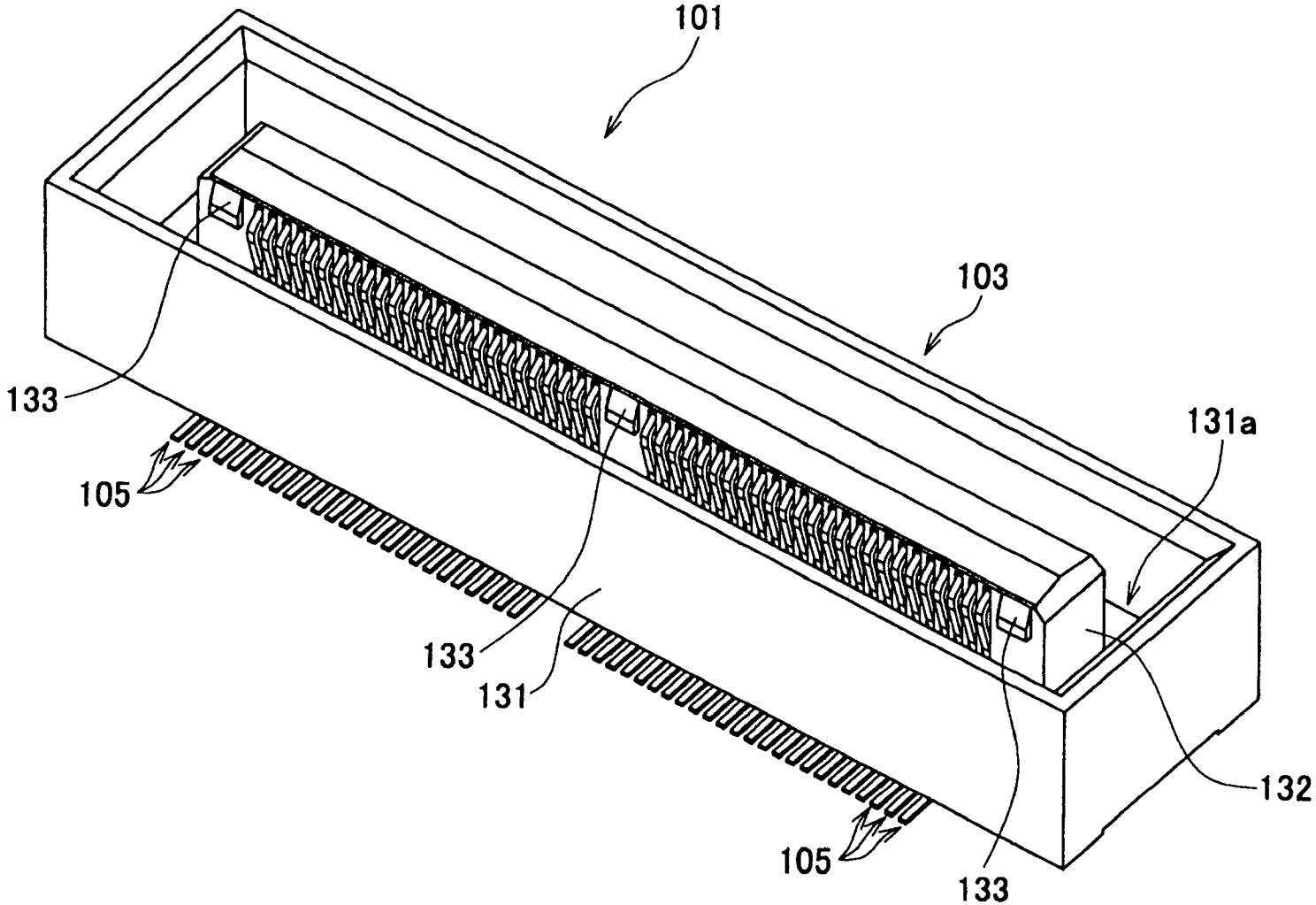
FIG. 1 is a perspective view of a socket-side connector according to a first embodiment of the present invention.
Figure 2:
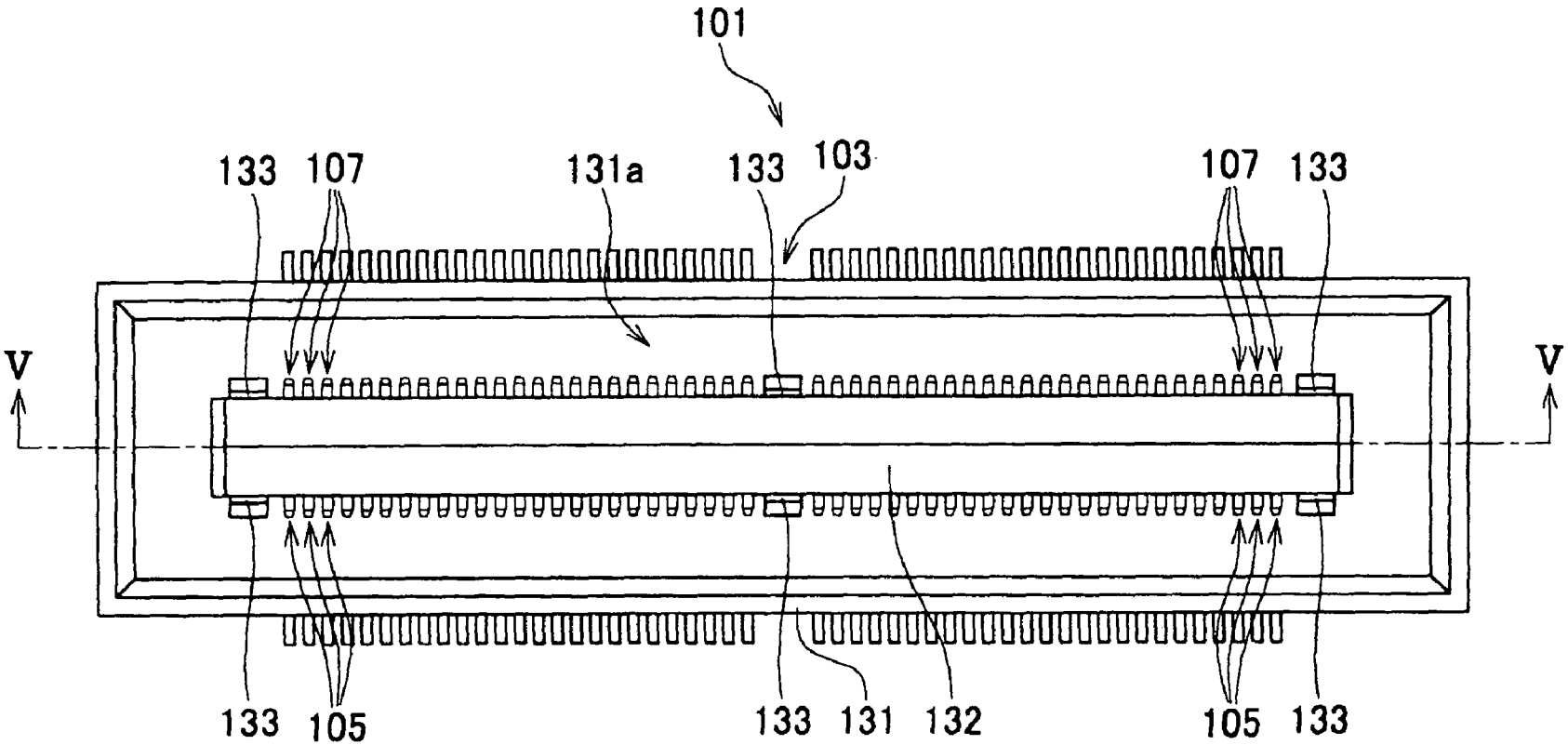
FIG. 2 is a plan view of the FIG. 1 socket-side connector.

Referring to FIGS. 1 and 2, a socket-side connector 101 according to a first embodiment of the present invention (connector, receptacle-side connector) is comprised of a housing 103, a plurality of first socket-side contacts (first contacts) 105, and a plurality of second socket-side contacts (second contacts) 107.

The housing 103 includes a casing portion 131 and a protrusion 132.

Figure 4:
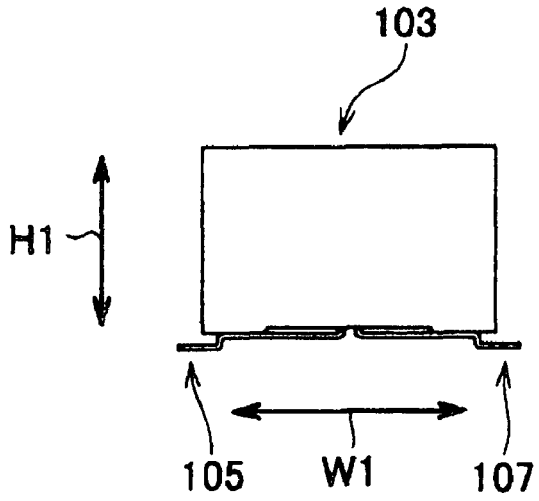
FIG. 4 is a side view of the FIG. 1 socket-side connector.

The casing portion 131 is in the form of a box with an upper surface thereof open, and has a receiving portion 131*a*. The receiving portion 131*a* is a space for receiving part of a plug-side connector 701, described hereinafter (see FIG. 8). Gaps G1 and G1 are each formed between an inner surface of the casing portion 131 and an opposed one of outer surfaces of a housing 703 of the plug-side connector 701 such that the plug-side connector 701 received in the receiving portion 131*a* can move by a predetermined distance in the direction (contact direction) of contact with contact portions 151 and 171, referred to hereinafter, of the first and second socket-side contacts 105 and 107 (see FIG. 8). In the present embodiment, the contact direction is approximately the same as the direction W1 of the width of the housing 103 (see FIG. 4).

Figure 3:
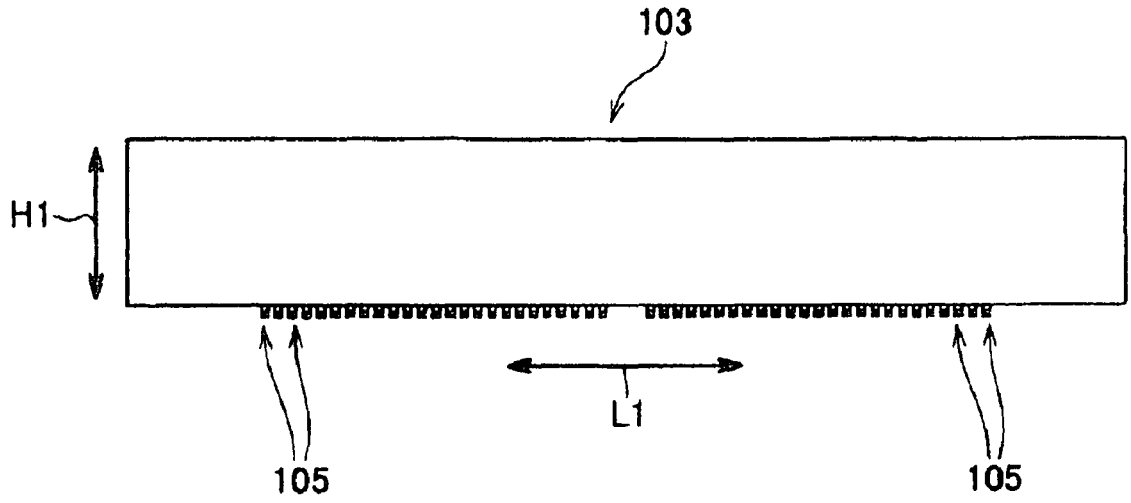
FIG. 3 is a front view of the FIG. 1 socket-side connector.

The protrusion 132 is approximately in the form of a long plate, and is formed on a bottom of the casing portion 131 in a manner extending along the direction L1 of the length of the housing 103 (see FIG. 3). In one surface of the protrusion 132, contact accommodating portions 132*a* are formed at equally-spaced intervals along the direction L1 of the length of the housing 103, and partition walls 132*b* are interposed between adjacent ones of the contact accommodating portions 132*a* (see FIG. 7). Part of each contact accommodating portion 132*a* faces the receiving portion 131*a*, and part thereof faces a space outside the housing 103. In the other surface of the protrusion 132, contact accommodating portions 132*c* are formed at equally-spaced intervals along the direction L1 of the length of the housing 103, and partition walls 132*d* are interposed between adjacent ones of the contact accommodating portions 132*c*. Part of each contact accommodating portion 132*c* faces the receiving portion 131*a*, and part thereof faces the space outside the housing 103.

Figure 6:
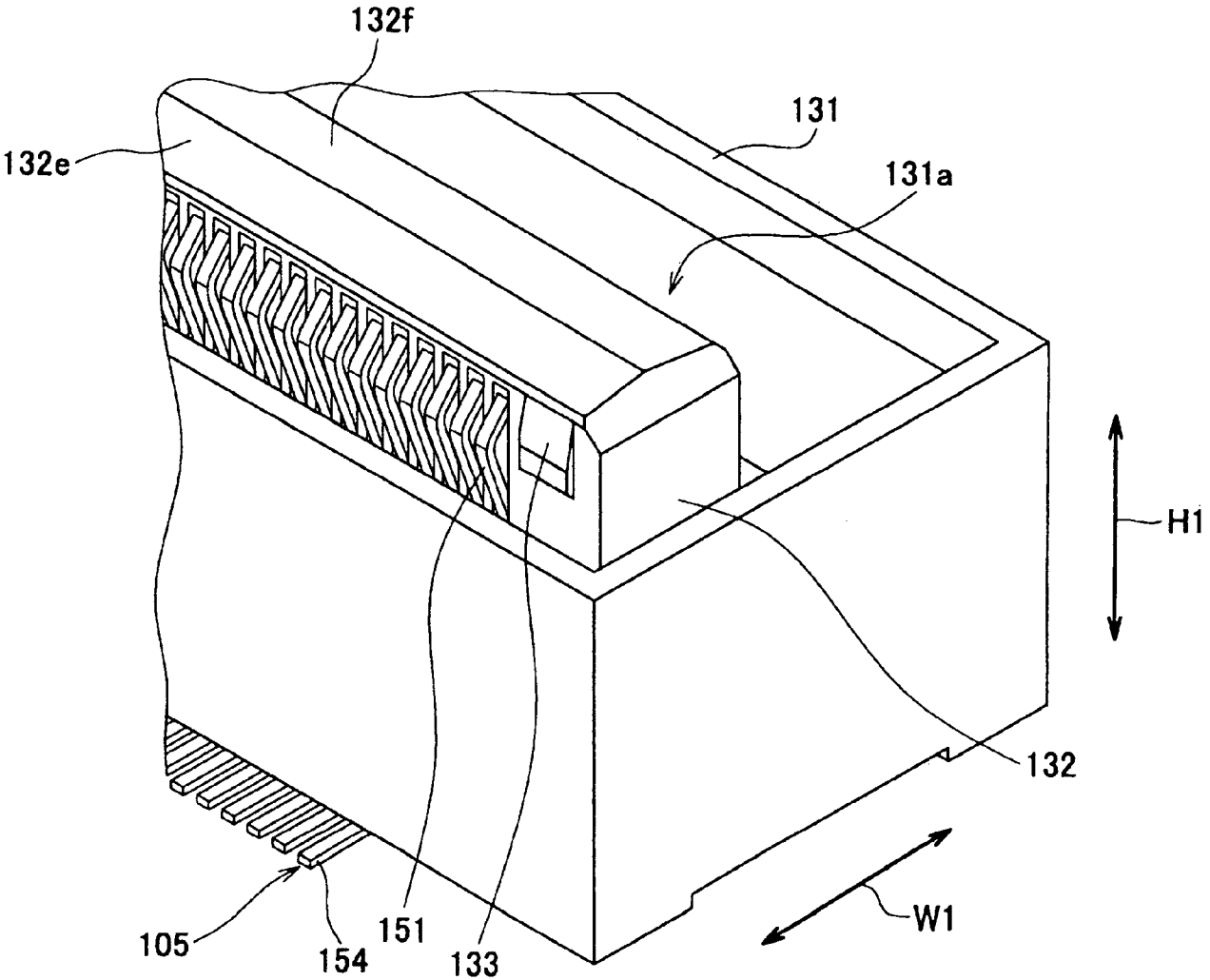
FIG. 6 is an enlarged view of one end of the FIG. 1 socket-side connector.
Figure 7:
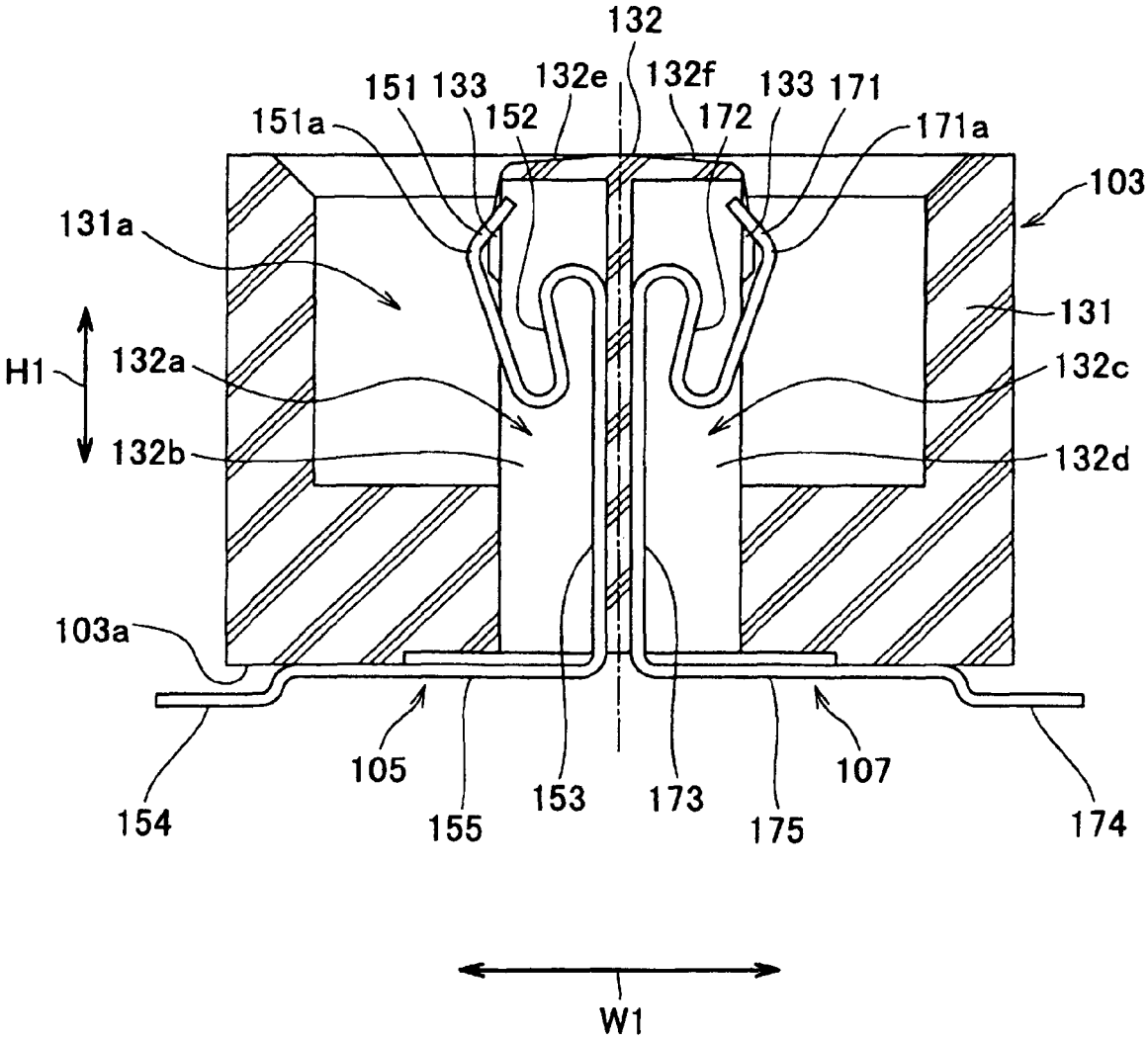
FIG. 7 is a cross-sectional view taken on line VII-VII of FIG. 5.

The protrusion 132 has a top thereof formed with sloping surfaces 132*e* and 132*f* (see FIGS. 6 and 7).

Figure 8:
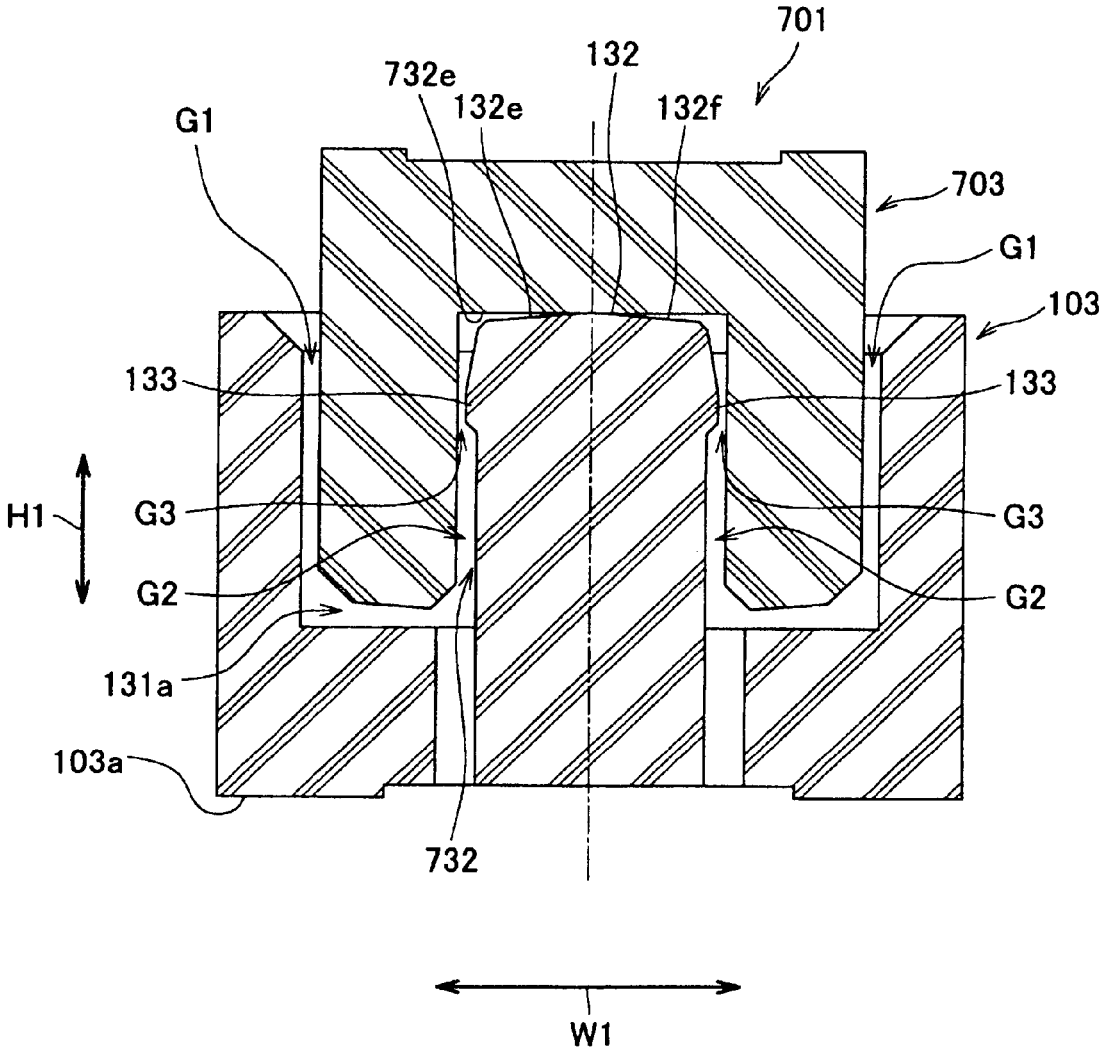
FIG. 8 is a cross-sectional view taken on line VIII-VIII of FIG. 5.

The protrusion 132 is inserted into a recess 732 of the housing 703 of the plug-side connector 701 (see FIG. 8). When inserted in a tilted manner, the sloping surface 132*e* or 132*f* of the protrusion 132 is brought into contact with a bottom 732*e* of the recess 732 (see FIG. 14). Further, gaps G2 and G2 are formed between opposite surfaces of the protrusion 132 and two inner surfaces of the recess 732 opposed to each other, respectively (see FIG. 8).

Each first socket-side contact 105 is comprised of the contact portion (first contact portion) 151, a spring portion (first spring portion) 152, a holding portion 153, a terminal portion 154, and a connecting portion 155 (see FIG. 7). The first socket-side contacts 105 all have the same size and the same shape.

The contact portion (first contact portion) 151 is located at one end of the first socket-side contact 105, and is bent into a substantially L-shape.

The spring portion 152 is connected to the contact portion 151, and is bent into a substantially S-shape such that it is elastically deformable.

The holding portion 153 is connected to the spring portion 152, and extends linearly. The holding portion 153 is sandwiched and held by adjacent ones of the partition walls 132*b*.

The terminal portion 154 is located at the other end of the first socket-side contact 105.

The connecting portion 155 is bent into a substantially crank-shape, and connects the holding portion 153 and the terminal portion 154.

Most part of the first socket-side contact 105 is accommodated in the contact accommodating portion 132*a*. Part of the contact portion 151 protrudes from the contact accommodating portion 132*a* into the receiving portion 131*a*, and the terminal portion 154 and the connecting portion 155 extend out on a bottom surface 103*a* of the housing 103.

Each second socket-side contact 107 is comprised of the contact portion (second contact portion) 171, a spring portion (second spring portion) 172, a holding portion 173, a terminal portion 174, and a connecting portion 175 (see FIG. 7). The second socket-side contacts 107 all have the same size and the same shape. Further, the second socket-side contacts 107 have the same size and shape as those of the first socket-side contacts 105. It should be noted that the first and second socket-side contacts 105 and 107 need not have the same size and shape insofar as the contact portions of the respective contacts 105 and 107 are located at the same positions.

The contact portion 171 is located at one end of the second socket-side contact 107, and is bent into a substantially L-shape.

The spring portion 172 is connected to the contact portion 171, and is bent into a substantially S-shape such that it is elastically deformable.

The holding portion 173 is connected to the spring portion 172, and extends linearly. The holding portion 173 is sandwiched and held by adjacent ones of the partition walls 132*d*.

The terminal portion 174 is located at the other end of the second socket-side contact 107.

The connecting portion 175 is bent into a substantially crank-shape, and connects the holding portion 173 and the terminal portion 174.

Most part of the second socket-side contact 107 is accommodated in the contact accommodating portion 132*c*. Part of the contact portion 171 protrudes from the contact accommodating portion 132*c* into the receiving portion 131*a*, and the terminal portion 174 and the connecting portion 175 extend out on the bottom surface 103*a* of the housing 103.

Figure 5:
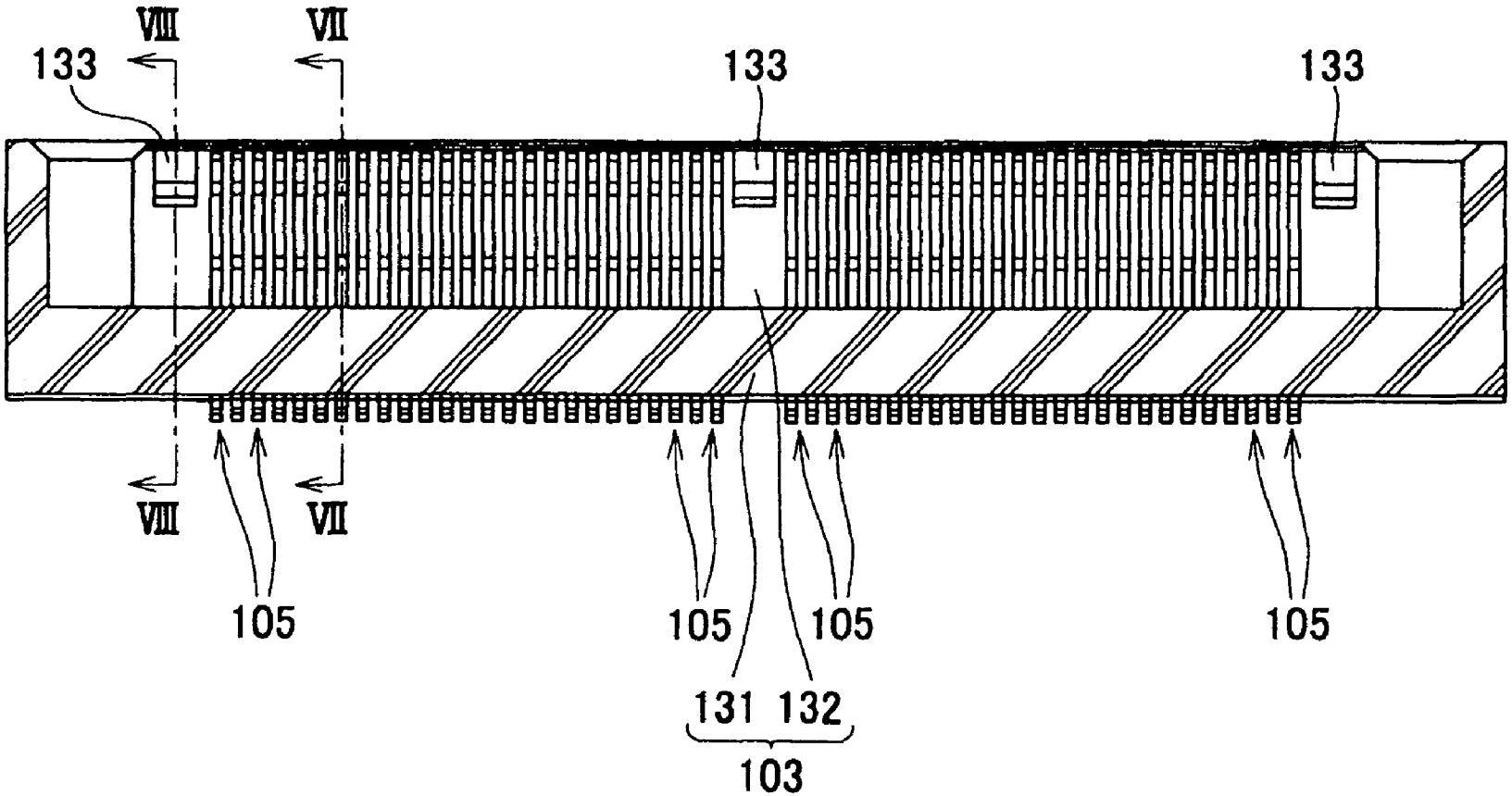
FIG. 5 is a cross-sectional view taken on line V-V of FIG. 2.

On an upper portion of one surface of the protrusion 132, three protruding portions (displacement-suppressing means) 133 are formed in a manner sandwiching the first socket-side contacts 105 (see FIGS. 1, 2 and 5).

Also on an upper portion of the other surface of the protrusion 132, three protruding portions (displacement-suppressing means) 133 are formed in a manner sandwiching the second socket-side contacts 107.

The positions of the tops (most protruding portions toward the respective receiving portion 131*a*) of the protruding portions 133 and those of contact points 151*a* and 171*a* of the respective contact portions 151 and 171 of the first and second socket-side contacts 105 and 107 (the respective positions in the direction H1 of the height of the housing 103 with reference to the bottom surface 103*a* of the housing 103) are approximately the same (see FIG. 7). Further, the amount of protrusion of the protruding portions 133 into the receiving portion 131*a* is smaller than the amount of protrusion of the contact points 151*a* and 171*a* in the direction W1 of the width of the housing 103 (see FIG. 7).

When the protrusion 132 is inserted into the recess 732 of the plug-side connector 701, only a small gap G3 is formed between each protruding portion 133 and an opposed one of two inner surfaces of the recess 732 (see FIG. 8). The gaps G3 and G3 are narrower than the gaps G1 and G1 and the gaps G2 and G2. The plug-side connector 701 inserted into the receiving portion 131*a* can be rotated about an approximately intermediate point O (see FIGS. 13 and 14) of an imaginary line connecting between the contact points 151*a* and 171*a* of the respective contact portions 151 and 171 by the action of the protruding portions 133 and the recess 132.

Figure 9:
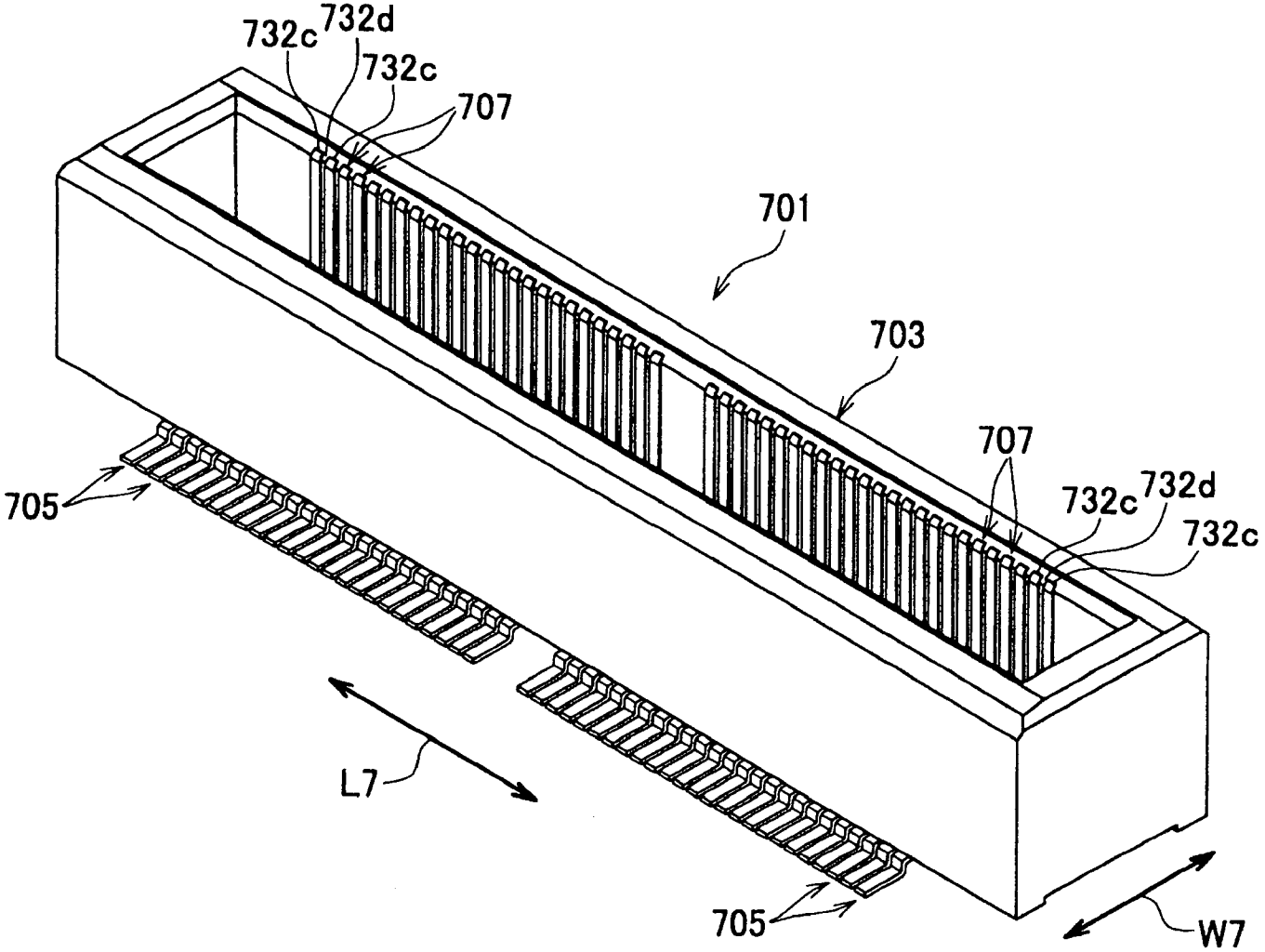
FIG. 9 is a perspective view of a plug-side connector connected to the FIG. 1 socket-side connector.
Figure 10:
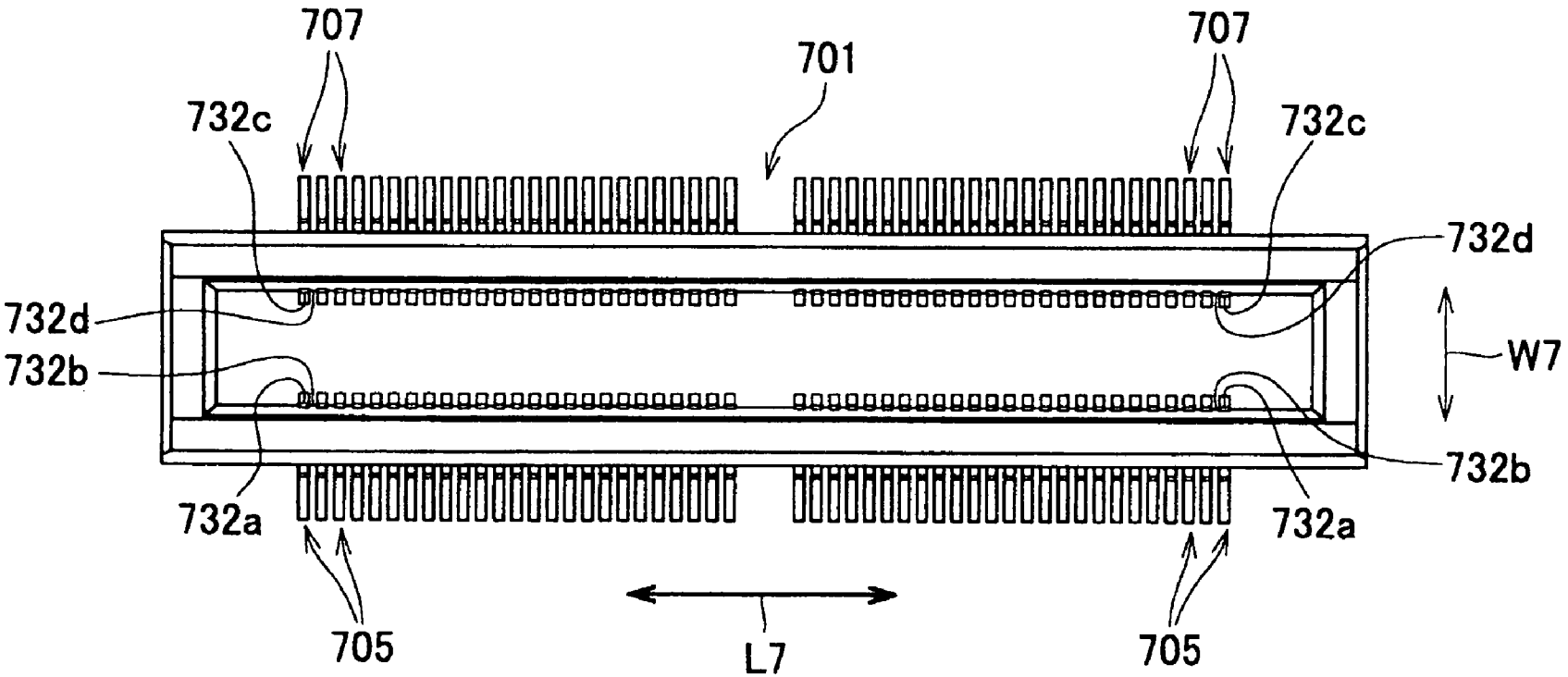
FIG. 10 is a plan view of the FIG. 9 plug-side connector.

Referring to FIGS. 9 and 10, the plug-side connector 701, which is a mating object to be connected to the socket-side connector 101, is comprised of the housing 703, a plurality of first plug-side contacts 705, and a plurality of second plug-side contacts 707.

The housing 703 is in the form of a box with one surface thereof open, and has a recess 732. The recess 732 receives the protrusion 132 of the socket-side connector 101 (see FIGS. 13 and 14).

In one of two opposed inner surfaces of the recess 732 of the housing 703, contact accommodating portions 732*a* are formed at equally-spaced intervals along the direction L7 of the length of the housing 703, and partition walls 732*b* are interposed between adjacent ones of the contact accommodating portions 732*a* (see FIG. 10). Part of each contact accommodating portion 732*a* faces the recess 732, and part thereof faces a space outside the housing 703.

In the other of the two opposed inner surfaces of the recess 732 of the housing 703, contact accommodating portions 732*c* are formed at equally-spaced intervals along the direction L7 of the length of the housing 703, and partition walls 732*d* are interposed between adjacent ones of the contact accommodating portions 732*c*. Part of each contact accommodating portion 732*c* faces the recess 732, and part thereof faces the space outside the housing 703.

Each first plug-side contact 705 is comprised of a contact portion (first mating contact portion) 751, a terminal portion 754, and a connecting portion 755. The first plug-side contacts 705 all have the same size and the same shape.

The contact portion 751 extends linearly, and is accommodated and held by an associated one of the contact accommodating portions 732*a*.

The terminal portion 754 is located at one end of the first plug-side contact 705.

The connecting portion 755 is bent into a substantially crank-shape, and connects the contact portion 751 and the terminal portion 754.

Each second plug-side contact 707 is comprised of a contact portion (second mating contact portion) 771, a terminal portion 774, and a connecting portion 775. The second plug-side contacts 707 all have the same size and the same shape. Further, the second plug-side contacts 707 have the same size and shape as those of the first plug-side contacts 705. It should be noted that the first and second plug-side contacts 705 and 707 need not have the same size and shape, and the sizes and shapes thereof may be different from each other.

The contact portion 771 extends linearly and is accommodated and held by an associated one of the contact accommodating portions 732*c*.

The terminal portion 774 is located at one end of the second plug-side contact 707.

The connecting portion 775 is bent into a substantially crank-shape, and connects the contact portion 771 and the terminal portion 774.

To connect the socket-side connector 101 and the plug-side connector 701, the plug-side connector 701 is positioned above the socket-side connector 101, and the bottom surface 103*a* of the housing 103 and a bottom surface 703*a* of the housing 703 are made substantially parallel to each other. From this state, the plug-side connector 701 is lowered along the direction H1 of the height of the housing 103, whereby it is fitted in the socket-side connector 101.

In the process in which the plug-side connector 701 is fitted in the socket-side connector 101, the contact portions 151 and 171 are brought into contact with the contact portions 751 and 771, respectively, and are slightly withdrawn into the contact accommodating portions 132*a* and 132*c*, respectively. At this time, spring forces are generated in the spring portions 152 and 172. These spring forces cause the contact portions 151 and 171 to be brought into strong contact with the contact portions 751 and 771, respectively.

Figure 13:
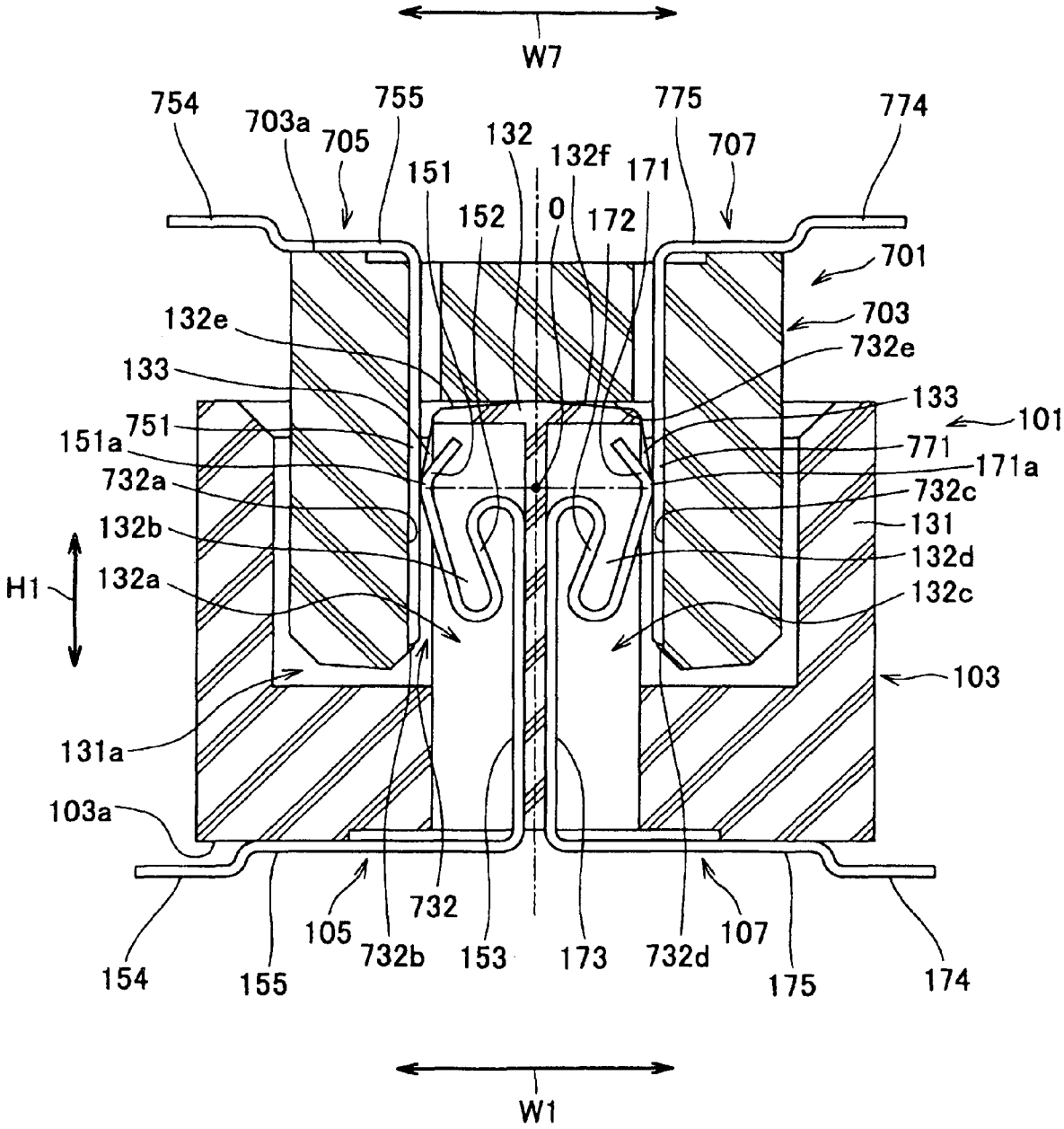
FIG. 13 is a cross-sectional of the FIG. 9 plug-side connector and the FIG. 1 socket-side connector in a state in which the former is fitted straight in the latter.

As described above, the plug-side connector 701 is connected to the socket-side connector 101 (see FIG. 13).

From the state shown in FIG. 13, when the plug-side connector 701 is tilted, the motion of the plug-side connector 701 in the contact direction is suppressed by the protruding portions 133, and the position of the plug-side connector 701 in the contact direction is hardly changed. Therefore, the respective contact forces of the contact portions 151 on the contact portions 751, and the respective contact forces of the contact portions 171 on the contact portions 771 are hardly changed.

Figure 14:
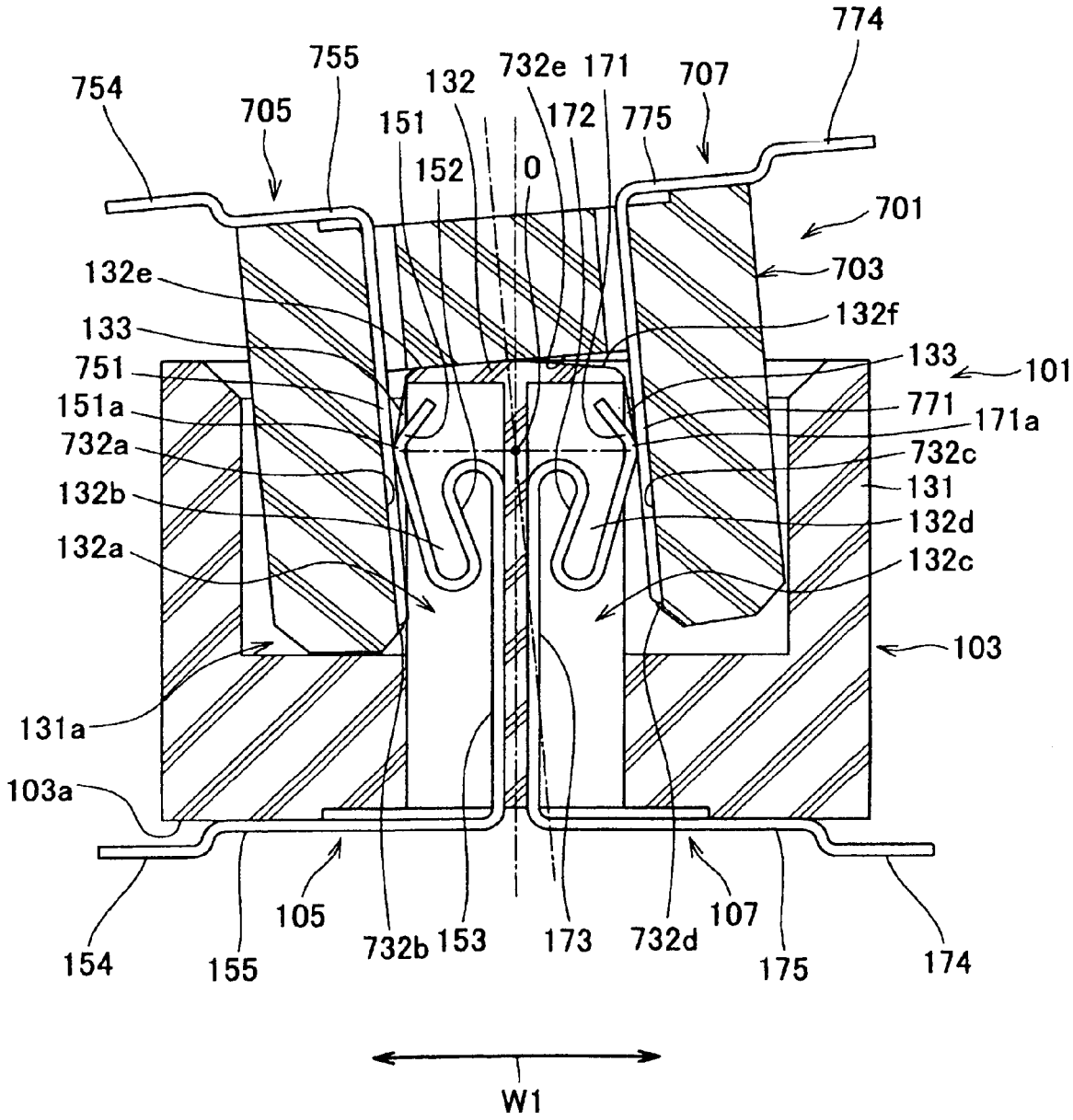
FIG. 14 is a cross-sectional of the FIG. 13 plug-side connector and the FIG. 13 socket-side connector in a state in which the former is tilted with respect to the latter.

As shown in FIG. 14, the amount of protrusion of the contact points 151*a* and 171*a* into the receiving portion 131*a* is set such that the socket-side connector 101 and the plug-side connector 701 are brought into contact with each other even when they are connected to each other in the state of the plug-side connector 701 being tilted with respect to the socket-side connector 101. As described above, even when the plug-side connector 701 is configured to be tiltable with respect to the socket-side connector 101 (the gaps G1 and G1, and the gaps G2 and G2 are set to be large), it is possible to ensure reliability of contact of the contact portions 151 and 171 with the contact portions 751 and 771.

Further, even when the plug-side connector 701 is obliquely fitted in the socket-side connector 101, the socket-side connector 101 and the plug-side connector 701 are positively connected to each other.

Figure 15:
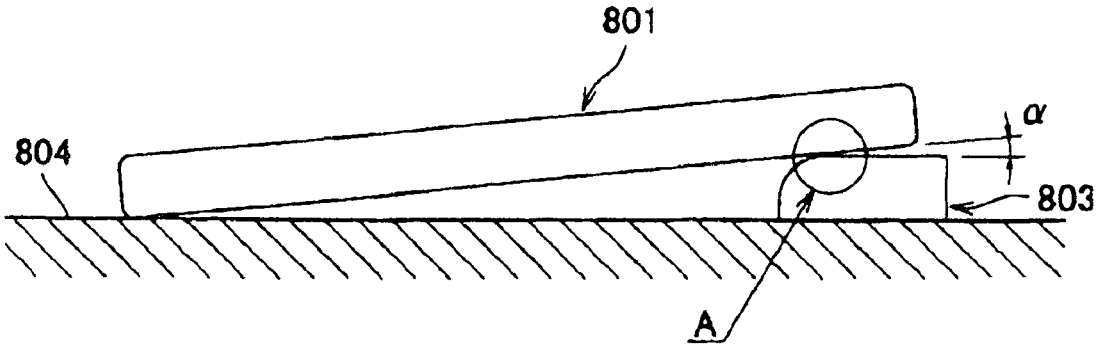
FIG. 15 is a conceptual view showing a state of use of the FIG. 13 socket-side connector and plug-side connector.
Figure 16:
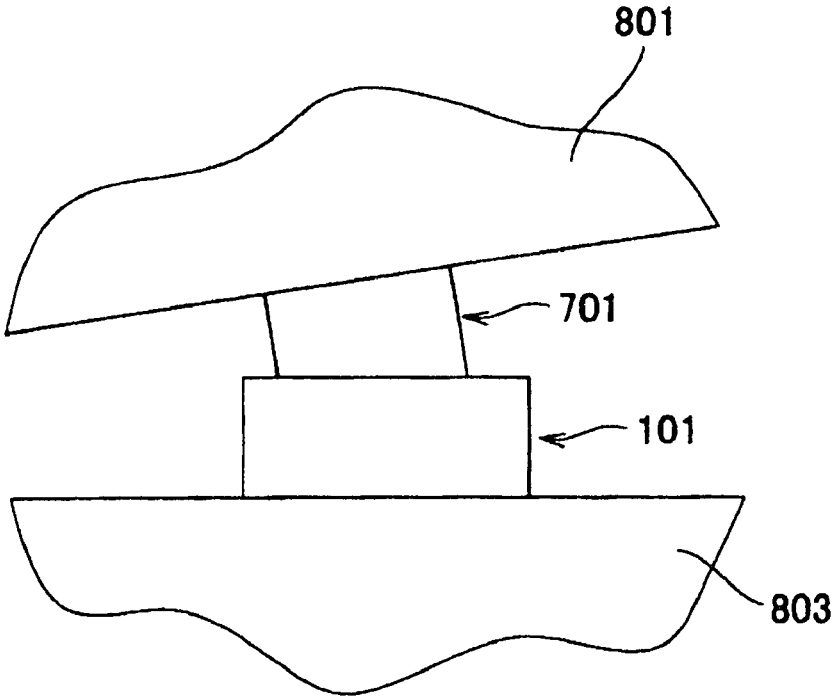
FIG. 16 is an enlarged view of part A appearing in FIG. 15.

Referring to FIGS. 15 and 16, the socket-side connector 101 according to the first embodiment is provided on the top of a docking station 803, and the plug-side connector 701 is provided in a bottom surface of one end of a notebook PC 801.

To connect the plug-side connector 701 of the notebook PC 801 to the socket-side connector 101 of the docking station 803, first, in a state in which the notebook PC 801 is held horizontal, the plug-side connector 701 is positioned above the socket-side connector 101, and the notebook PC 801 is lowered to connect the plug-side connector 701 to the socket-side connector 101. Finally, the other end of the notebook PC 801 is placed on a surface 804 on which the docking station 803 is set. At this time, although the notebook PC 801 pivots about one end thereof and the plug-side connector 701 is tilted with respect to the socket-side connector 101, there is little fear of occurrence of faulty contact between the socket-side connector 101 and the plug-side connector 701, since the socket-side connector 101 is used, as described above.

Figure 17:
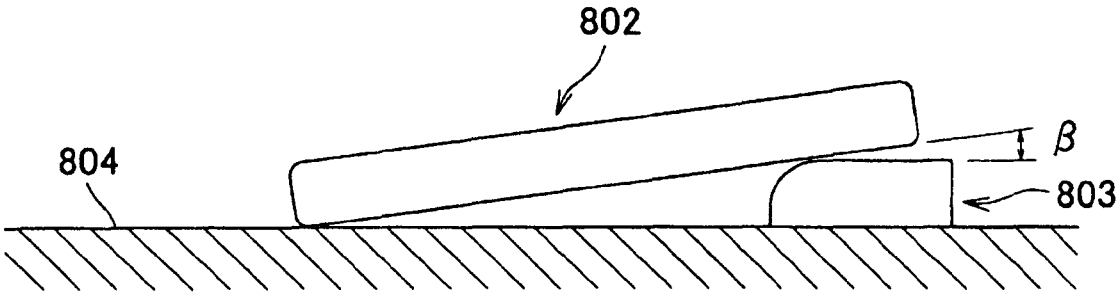
FIG. 17 is a conceptual view showing another state of use of the FIG. 13 socket-side connector and plug-side connector.

As shown in FIG. 17, when a plug-side connector, not shown, which is provided at one end of a notebook PC 802 that has a smaller transverse size than the notebook PC 801, is connected to the socket-side connector 101 of the docking station 803, an angle β formed between the bottom surface of the notebook PC 802 and the top of the docking station 803 is larger than an angle α formed between the bottom surface of the notebook PC 801 and the top of the docking station 803. However, since the gaps G1, G1, G2 and G2 are set to be large in the socket-side connector 101, it is possible to cope with the tilting of the notebook PC 802. Further, since the motion of the notebook PC 802 in the contact direction is suppressed by the protruding portions 133, there is little fear of occurrence of faulty contact between the socket-side connector 101 and the plug-side connector 701.

Figure 18:
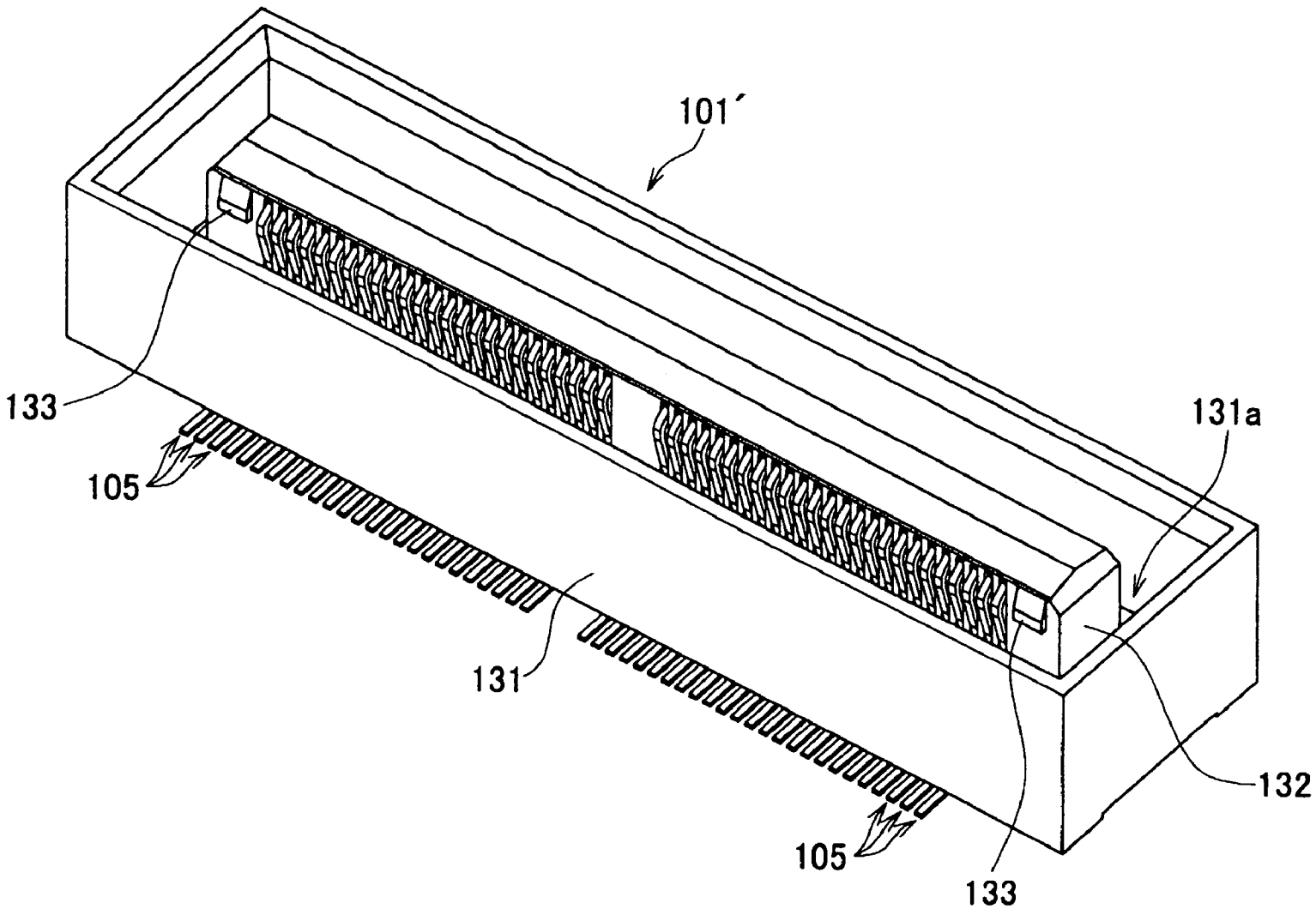
FIG. 18 is a perspective view of a variation of the FIG. 1 socket-side connector.

Referring to FIG. 18, a socket-side connector 101' is a variation of the FIG. 1 socket-side connector 101. Component parts identical to those of the connector according to the first embodiment are designated by identical reference numerals, and detailed description thereof is omitted, while only main component parts different in construction from those of the first embodiment will be described hereinafter.

Although in the first embodiment, the three protruding portions 133 are formed on each upper portion of the both surfaces of the protrusion 132, the socket-side connector 101' has two protruding portions 133 formed on each upper portion of the both surfaces of the protrusion 132.

According to this variation, the same advantageous effects as provided by the first embodiment are obtained.

Figure 19:
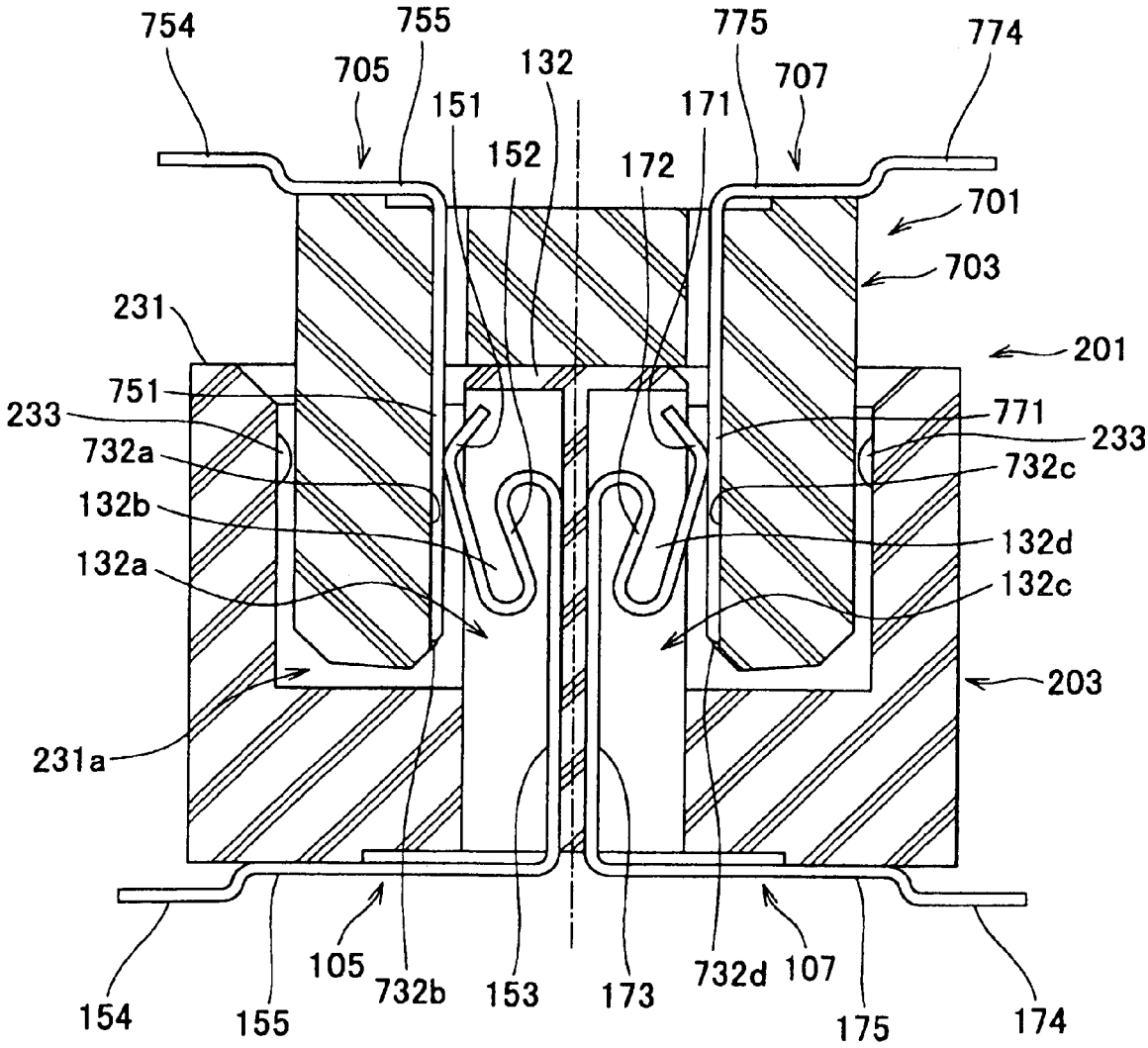
FIG. 19 is a cross-sectional of a socket-side connector according to a second embodiment of the present invention in a fitted state.

FIG. 19 is a cross-sectional view of a socket-side connector according to a second embodiment of the present invention in a fitted state. Component parts identical to those of the connector according to the first embodiment are designated by identical reference numerals, and detailed description thereof is omitted, while only main component parts different in construction from those of the first embodiment will be described hereinafter.

Although the socket-side connector 101 according to the first embodiment has the protruding portions 133 formed on the both surfaces of the protrusion 132, as shown in FIG. 19, the socket-side connector 201 according to the second embodiment has protruding portions 233 formed on two opposed inner surfaces of a casing portion 231 of a housing 203.

According to the second embodiment, the same advantageous effects as provided by the first embodiment are obtained.

Next, a card edge connector according to a third embodiment of the present invention will be described with reference to FIGS. 20 to 27.

Referring to FIGS. 20 to 23, the card edge connector (connector) 301 is comprised of a housing 303, a plurality of first contacts 305, and a plurality of second contacts 307.

The housing 303 includes a receiving portion 331. The receiving portion 331 is a space for receiving one end of the circuit board 901 (see FIGS. 25 and 26). Gaps G7 and G7 are formed between two opposed inner surfaces of the receiving portion 331 and opposite surfaces of the circuit board (mating object to be connected) 901, respectively, such that the circuit board 901 received in the receiving portion 331 can move by a predetermined distance in the direction (contact direction) of contact with contact portions 351 and 371, referred to hereinafter, of the first and second contacts 305 and 307 (see FIGS. 25 and 26). Also in the third embodiment, the contact direction is approximately the same as the direction W3 of the width of the housing 303 (see FIGS. 20 and 23).

Figure 24:
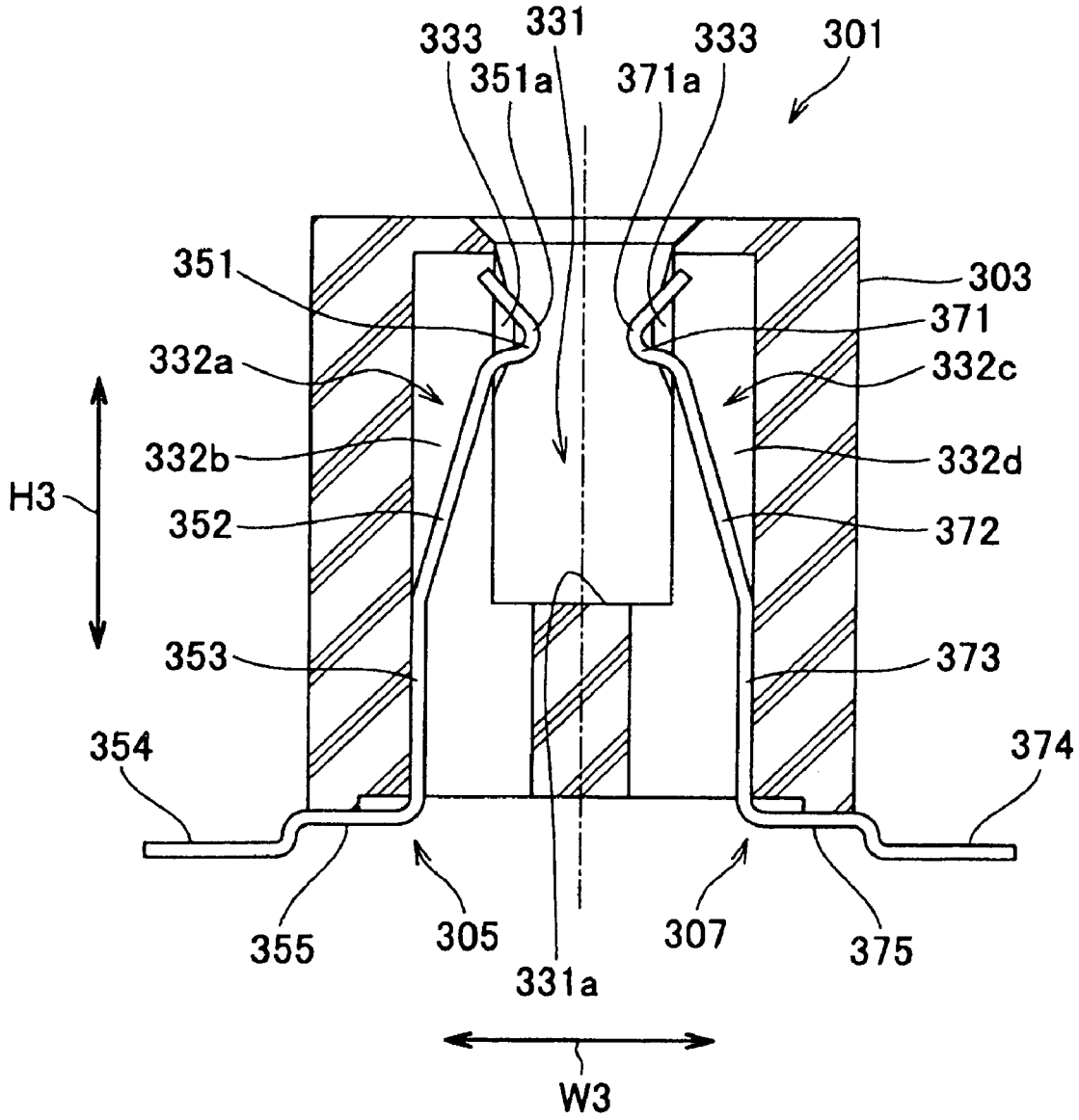
FIG. 24 is a cross-sectional view taken on line XXIV-XXIV of FIG. 22.

In the one of the two opposed inner surfaces of the receiving portion 331, contact accommodating portions 332*a* are formed at equally-spaced intervals along the direction L3 of the length of the housing 303, and partition walls 332*b* are interposed between adjacent ones of the contact accommodating portions 332*a* (see FIG. 24). Part of each contact accommodating portion 332*a* faces the receiving portion 331, and part thereof faces a space outside the housing 303. In the other of the two opposed inner surfaces of the receiving portion 331, contact accommodating portions 332*c* are formed at equally-spaced intervals along the direction L3 of the length of the housing 303, and partition walls 332*d* are interposed between adjacent ones of the contact accommodating portions 332*c*. Part of each contact accommodating portion 332*c* faces the receiving portion 331, and part thereof faces the space outside the housing 303.

Figure 26:
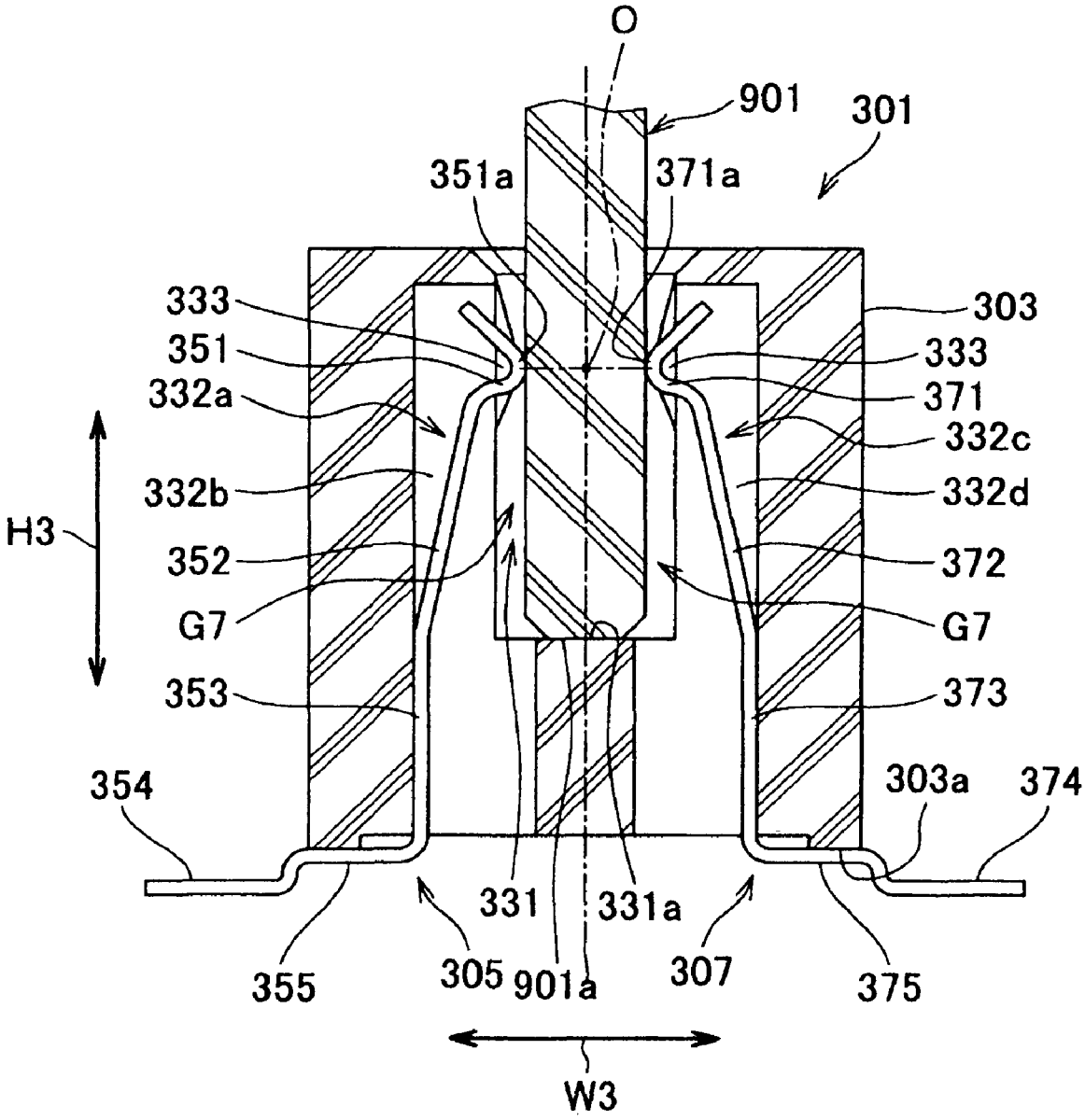
FIG. 26 is a cross-sectional view taken on line XXIV-XXIV of FIG. 22, in a state in which the circuit board is inserted into the FIG. 20 card edge connector.
Figure 27:
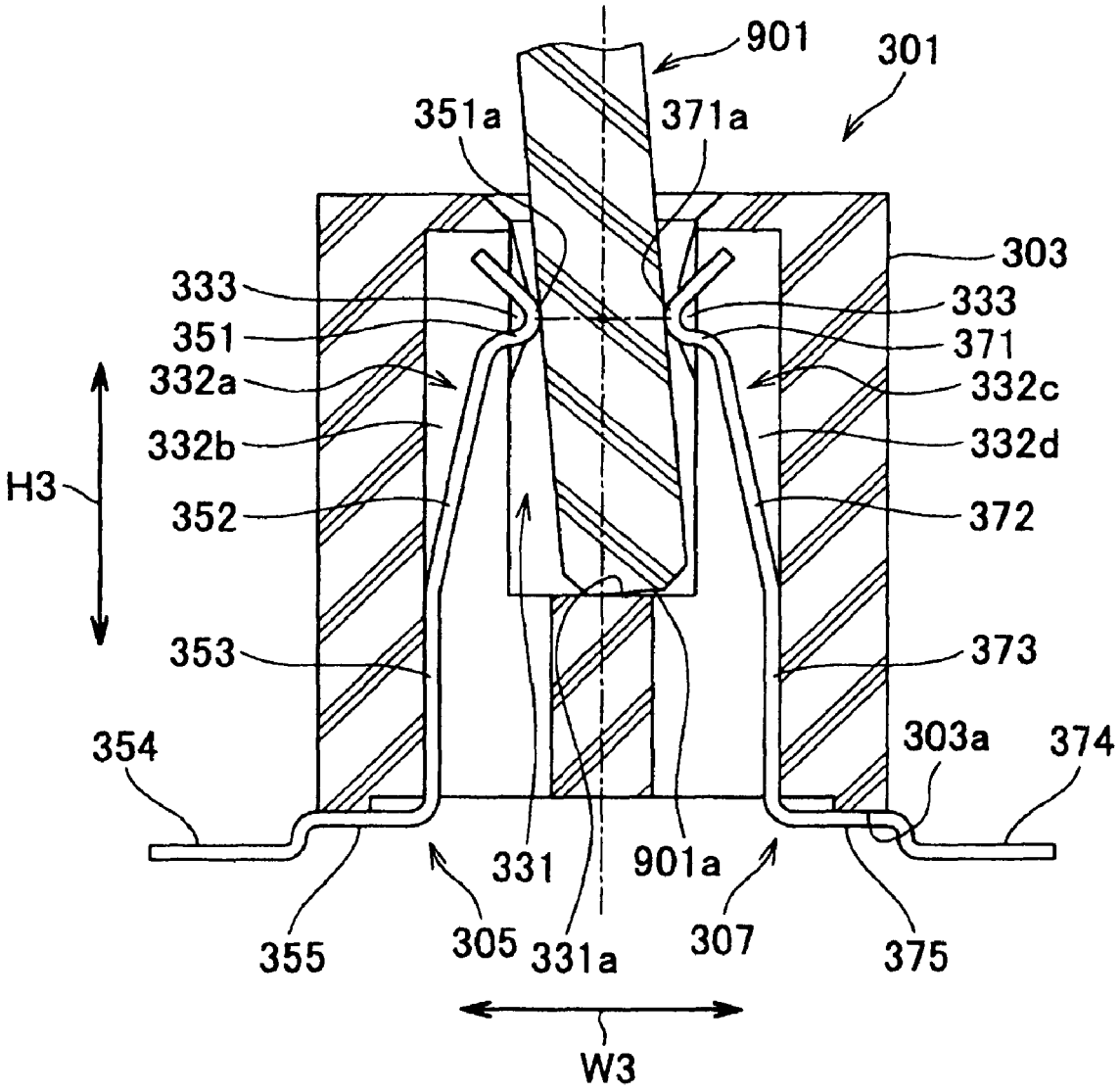
FIG. 27 is a cross-sectional view taken on line XXIV-XXIV of FIG. 22, in a state in which the circuit board is tilted.

Each first contact 305 is comprised of the contact portion (first contact portion) 351, a spring portion (first spring portion) 352, a holding portion 353, a terminal portion 354, and a connecting portion 355 (see FIGS. 24 and 26). The first contacts 305 all have the same size and the same shape.

The contact portion 351 is located at one end of the first contact 305, and is bent into a substantially J-shape.

The spring portion 352 is connected to the contact portion 351, and linearly extends such that it is elastically deformable.

The holding portion 353 is connected to the spring portion 352, and extends linearly. The holding portion 353 is sandwiched and held by adjacent ones of the partition walls 332*b*

The terminal portion 354 is located at the other end of the first contact 305.

The connecting portion 355 is bent into a substantially crank-shape, and connects the holding portion 353 and the terminal portion 354.

Most part of the first contact 305 is accommodated in the contact accommodating portion 332*a*. A contact point 351*a* of the contact portion 351 protrudes from the contact accommodating portion 332*a* into the receiving portion 331, and the terminal portion 354 and the connecting portion 355 extend out on a bottom surface of the housing 303.

Each second contact 307 is comprised of the contact portion (second contact portion) 371, a spring portion (second spring portion) 372, a holding portion 373, a terminal portion 374, and a connecting portion 375 (see FIGS. 24 and 26). The second contacts 307 all have the same size and the same shape. Further, the second contacts 307 have the same size and shape as those of the first contact 305. It should be noted that the first and second contacts 305 and 307 need not have the same size and shape, and the sizes and shapes thereof may be different from each other insofar as the contact portions of the respective contacts 305 and 307 are located at the same positions.

The contact portion 371 is located at one end of the second socket-side contact 307, and is bent into a substantially J-shape.

The spring portion 372 is connected to the contact portion 371, and extends linearly such that it is elastically deformable.

The holding portion 373 is connected to the spring portion 372, and extends linearly. The holding portion 373 is sandwiched and held by adjacent ones of the partition walls 331*d*.

The terminal portion 374 is located at the other end of the second contact 307.

The connecting portion 375 is bent into a substantially crank-shape, and connects the holding portion 373 and the terminal portion 374.

Most part of the second contact 307 is accommodated in the contact accommodating portion 332*c*. Part of the contact portion 371 protrudes from the contact accommodating portion 332*c* into the receiving portion 331, and the terminal portion 374 and the connecting portion 375 extend out on the bottom surface of the housing 303.

Figure 20:
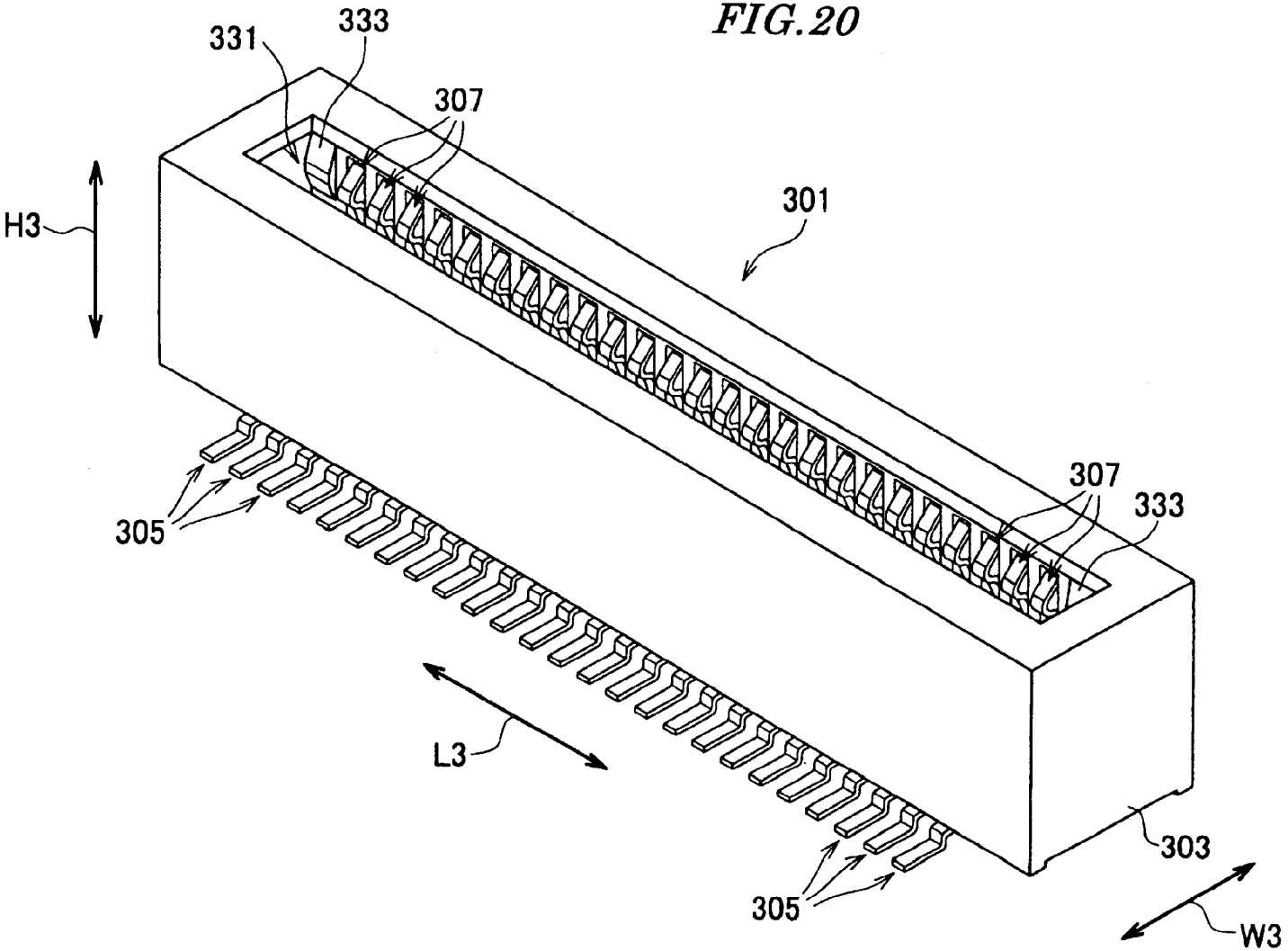
FIG. 20 is a perspective view of a card edge connector according to a third embodiment of the present invention.
Figure 21:
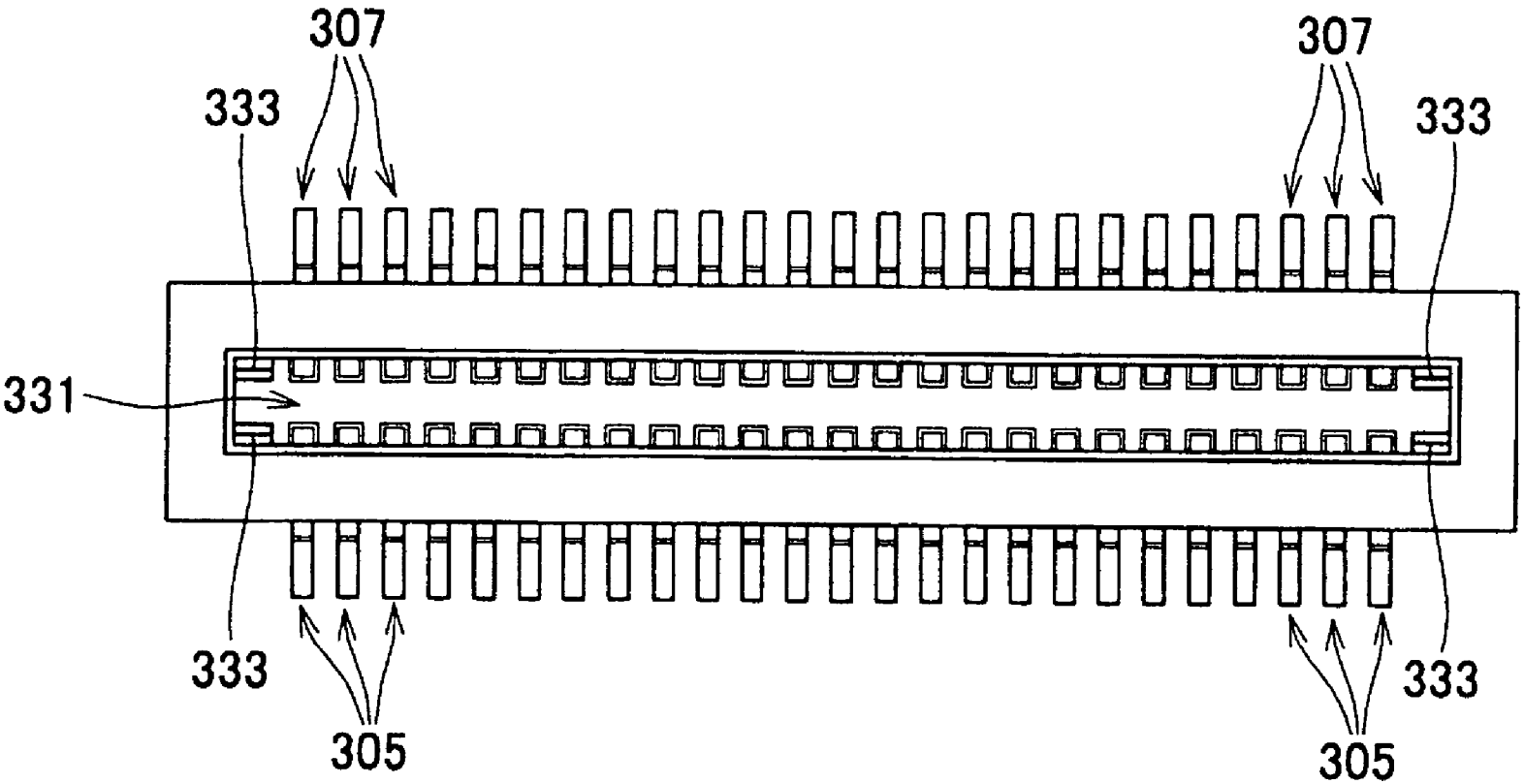
FIG. 21 is a plan view of the FIG. 20 card edge connector.

On an upper portion of the one of the two opposed inner surfaces of the receiving portion 331, two protruding portions (displacement-suppressing means) 333 are formed in a manner sandwiching the first contacts 305 (see FIGS. 20, 21 and 24).

Also on an upper portion of the other of the two opposed inner surfaces of the receiving portion 331, two protruding portions (displacement-suppressing means) 333 are formed in a manner sandwiching the second contacts 307.

The positions of the tops (most protruding portions toward the respective receiving portion 331) of the protruding portions 333 and those of contact points 351*a* and 371*a* of the respective contact portions 351 and 371 of the first and second socket-side contacts 305 and 307 (the respective positions in the direction H3 of the height of the housing 303 with reference to the bottom surface 303*a* of the housing 303) are approximately the same (see FIG. 24). Further, the amount of protrusion of the protruding portions 333 into the receiving portion 331 is smaller than the amount of protrusion of the contact points 351*a* and 371*a* in the direction W3 of the width of the housing 303 (see FIG. 24).

Figure 25:
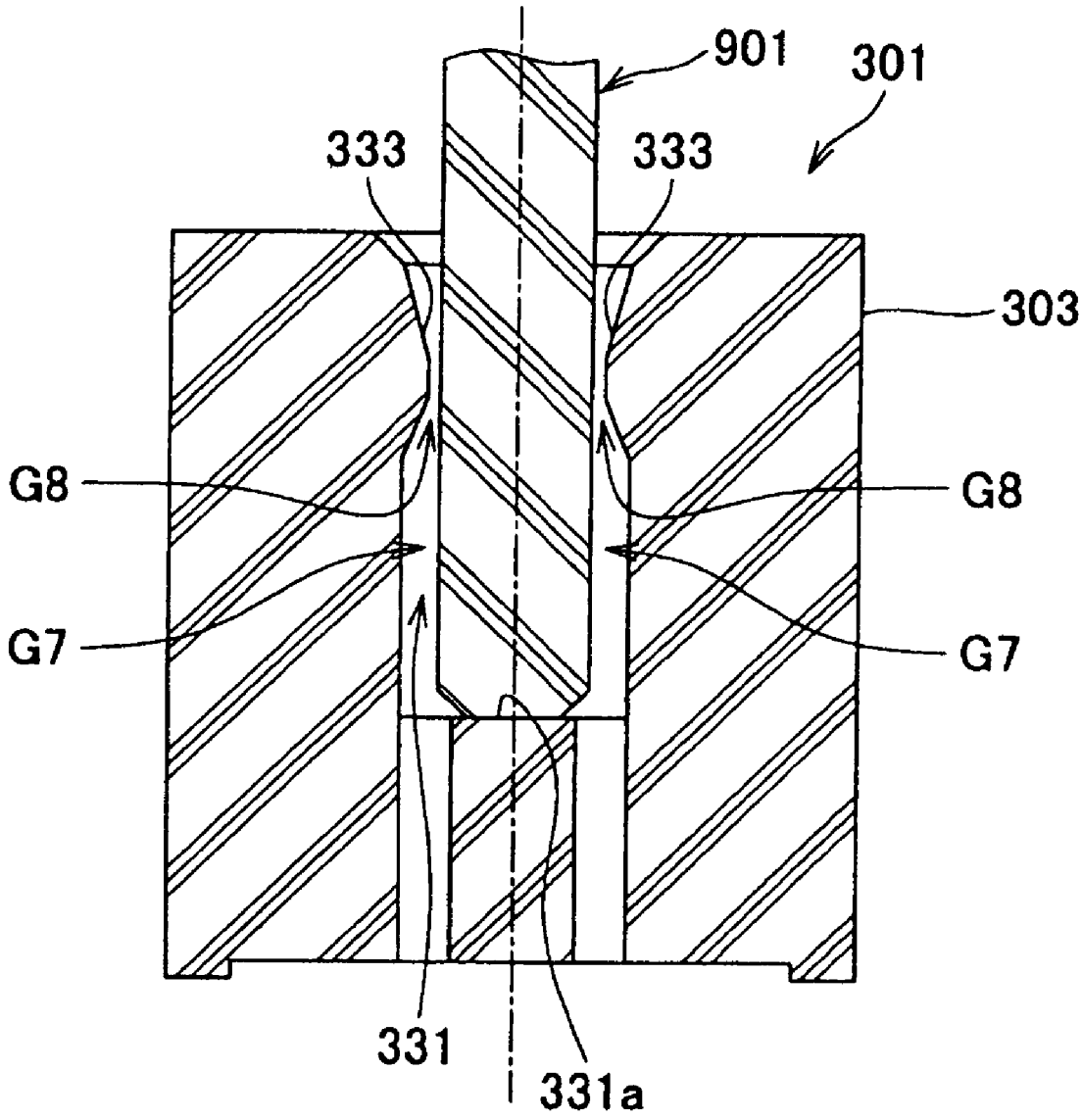
FIG. 25 is a cross-sectional view taken on line XXV-XXV of FIG. 22, in a state in which a circuit board is inserted into the FIG. 20 card edge connector.

When the circuit board 901 is inserted into the receiving portion 331 of the card edge connector 301, small gaps G8 and G8 are formed between the protruding portions 333 and opposite surfaces of the circuit board 901 (see FIG. 25). The gaps G8 and G8 are narrower than the gaps G7 and G7. The circuit board 901 inserted into the receiving portion 331 can be rotated about an approximately intermediate point O (see FIGS. 26 and 27) of an imaginary line connecting between the contact points 351*a* and 371*a* of the respective contact portions 351 and 371 by the action of the protruding portions 333 and a bottom 331*a* of the receiving portion 331.

To connect the circuit board 901 to the card edge connector 301, the circuit board 901 is positioned above the card edge connector 301, and a foremost end surface 901*a* (see FIG. 26) of the circuit board 901 and the bottom surface 303*a* (see FIG. 26) of the housing 303 are made approximately parallel to each other. From this state, the circuit board 901 is lowered along the direction H3 of the height of the housing 303, and is fitted to the card edge connector 301.

In the process in which the circuit board 901 is fitted to the card edge connector 301, the respective contact portions 351 and 371 are brought into contact with pads, not shown, which are arranged on opposite surfaces of the circuit board 901 as first and second mating contact portions, and slightly withdrawn into the contact accommodating portions 332*a* and 332*c*. At this time, spring forces are generated in the spring portions 352 and 372 to cause the respective contact portions 351 and 371 to be brought into strong contact with the pads of the circuit board 901.

Thus, the circuit board 901 is connected to the card edge connector 301.

From the state shown in FIG. 26, when the circuit board 901 is tilted, the motion of the circuit board 901 in the contact direction (which is approximately parallel to the direction W3 of the width of the housing 303 also in the third embodiment) is suppressed by the protruding portions 333, and hence part of the circuit board 901, sandwiched by the contact points 351*a* and 371*a* is hardly changed in position in the contact direction. Therefore, the contact forces of the contact portions 351 and 371 on the pads of the circuit board 901 are hardly changed.

As described above, even when the circuit board 901 is configured to be tiltable with respect to the card edge connector 301 (the gaps G7 and G7 are set to be large), it is possible to ensure the reliability of contact of the contact portions 351 and 371 with the pads of the circuit board 901.

Further, even when the circuit board 901 is obliquely fitted to the card edge connector 301, the card edge connector 301 and the circuit board 901 are positively connected to each other.

Figure 29:
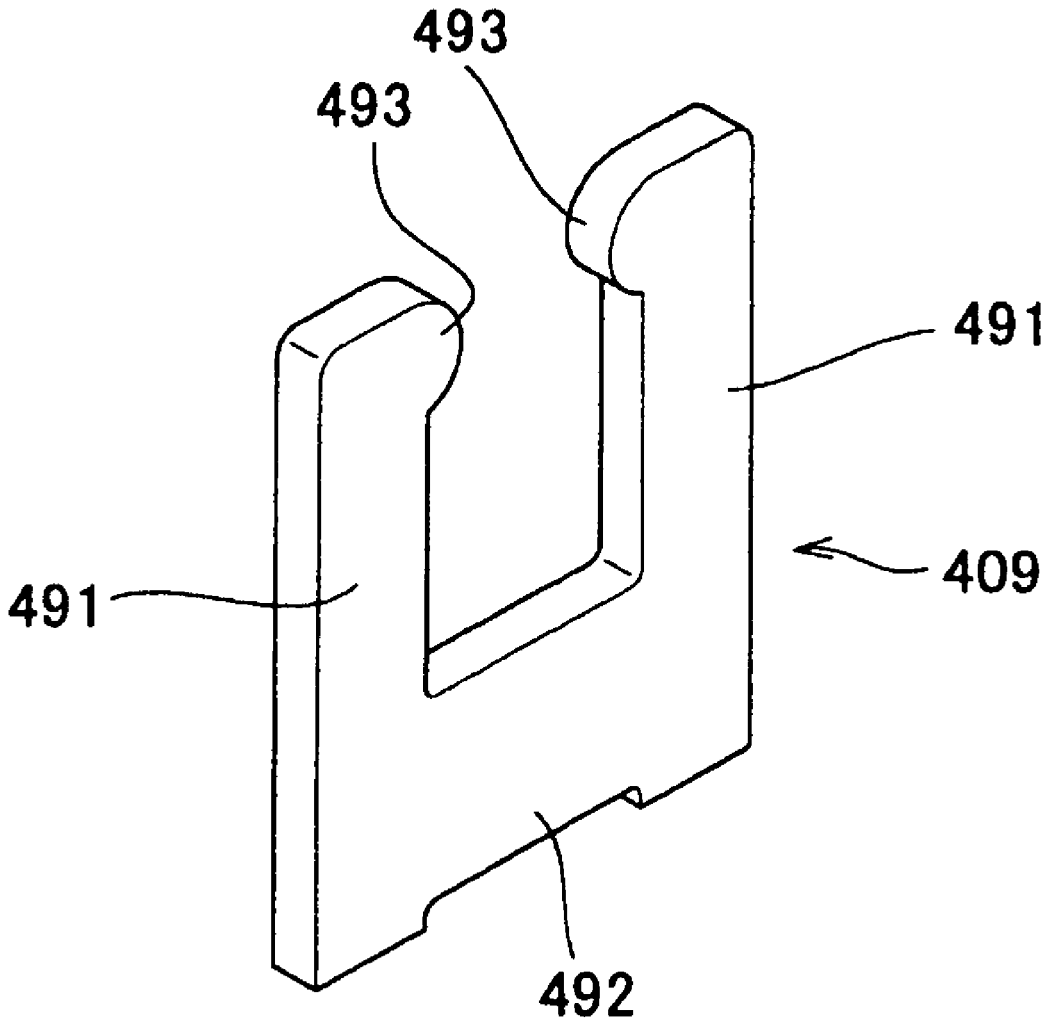
FIG. 29 is a perspective view of a displacement-suppressing member of the FIG. 28 card edge connector.

Next, a card edge connector according to a fourth embodiment of the present invention will be described with reference to FIG. 29.

The fourth embodiment has approximately the same construction as that of the third embodiment, so that only main component parts different in construction from those of the first embodiment will be described hereinafter.

Although in the card edge connector 301 according to the third embodiment, the protruding portions 333, which are the displacement-suppressing means, are formed on the inner surfaces of the housing 303, in the card edge connector 401 according to the fourth embodiment, the displacement-suppressing member 409, which is the displacement-suppressing means, is provided as a separate member from a housing 403.

Figure 28:
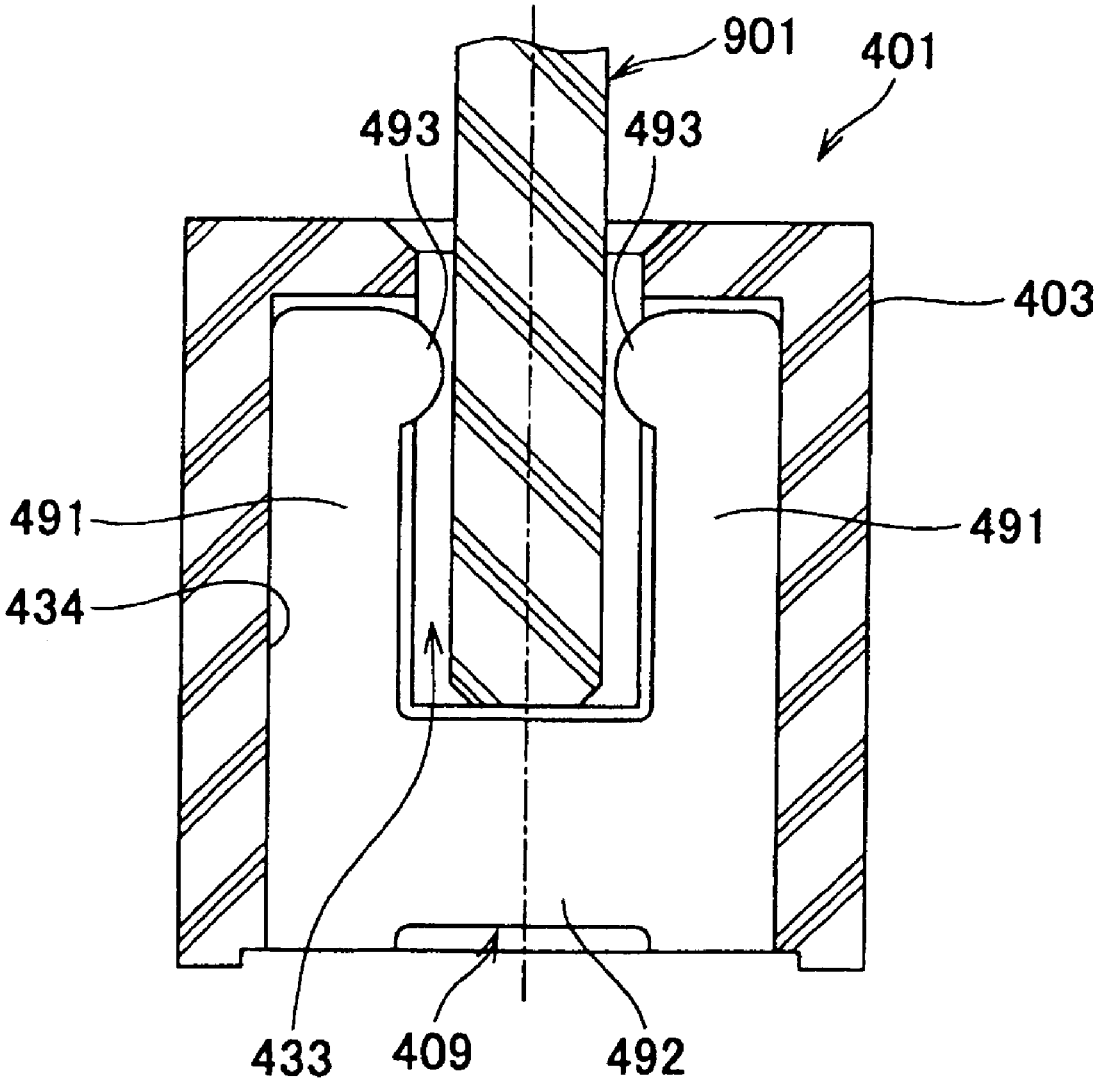
FIG. 28 is a cross-sectional view of a card edge connector according to a fourth embodiment of the present invention.

Displacement-suppressing member accommodating portions 434 are formed at respective opposite ends of the housing 403 in the direction of the length thereof (see FIG. 28). Part of each displacement-suppressing member accommodating portion 434 faces a receiving portion 433, and part thereof faces a space outside the housing 403 (see FIG. 29).

Each displacement-suppressing members 409 includes two arm sections 491, a connecting portion 492, and two protruding portions 493. The protruding portions 493 are opposed to each other via the receiving portion 433. The connecting portion 492 connects the arm sections 491. The protruding portions 493 are provided on foremost ends of the respective arm sections 491. The displacement-suppressing members 409 are each formed by blanking a metal plate. The displacement-suppressing members 409 are accommodated and held by the displacement-suppressing member accommodating portions 434.

The fourth embodiment provides the same advantageous effects as provided by the third embodiment.

Next, a card edge connector according to a fifth embodiment of the present invention will be described with reference to FIGS. 30 and 31.

Figure 30:
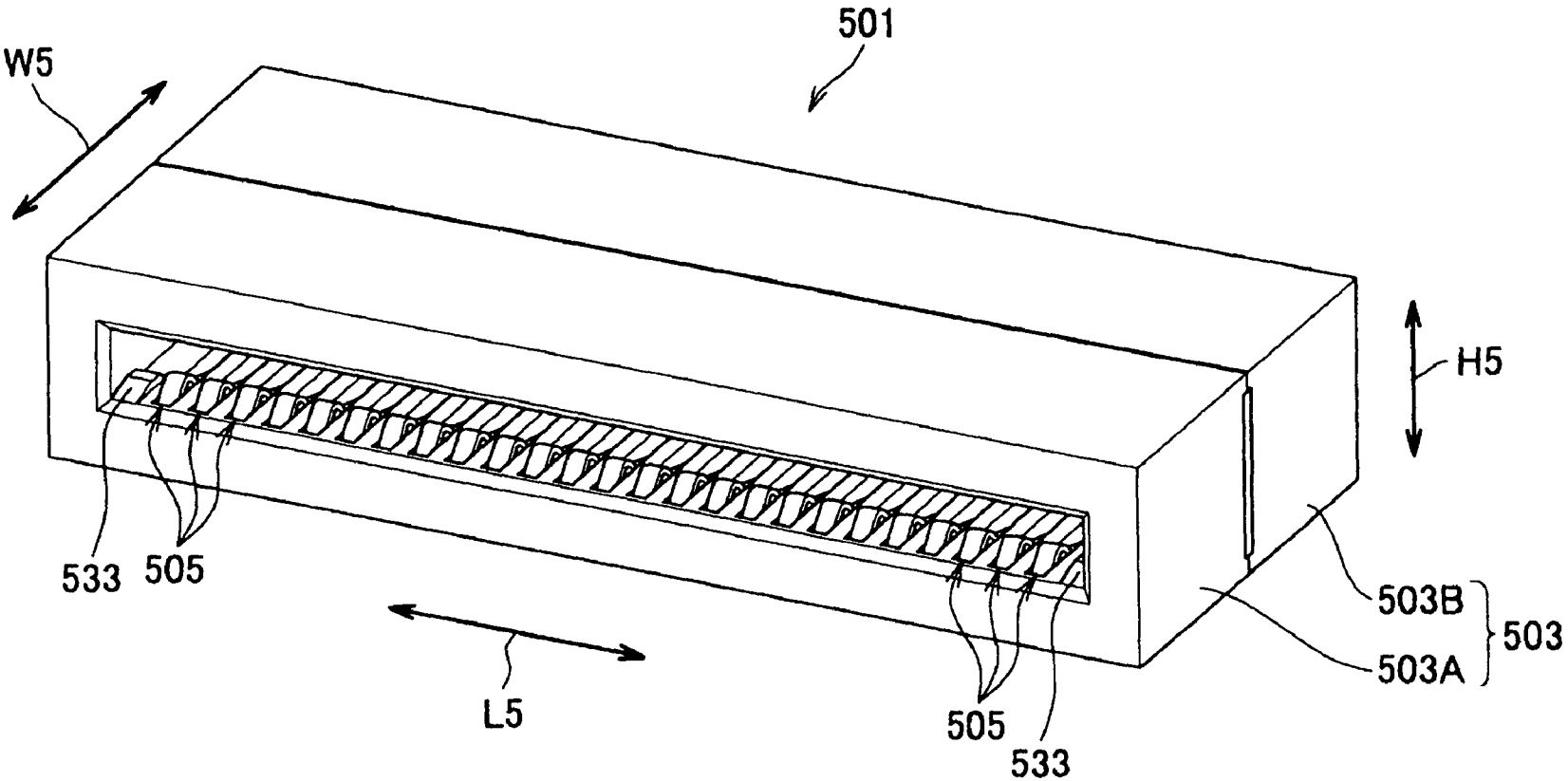
FIG. 30 is a perspective view of a card edge connector according to a fifth embodiment of the present invention.
Figure 31:
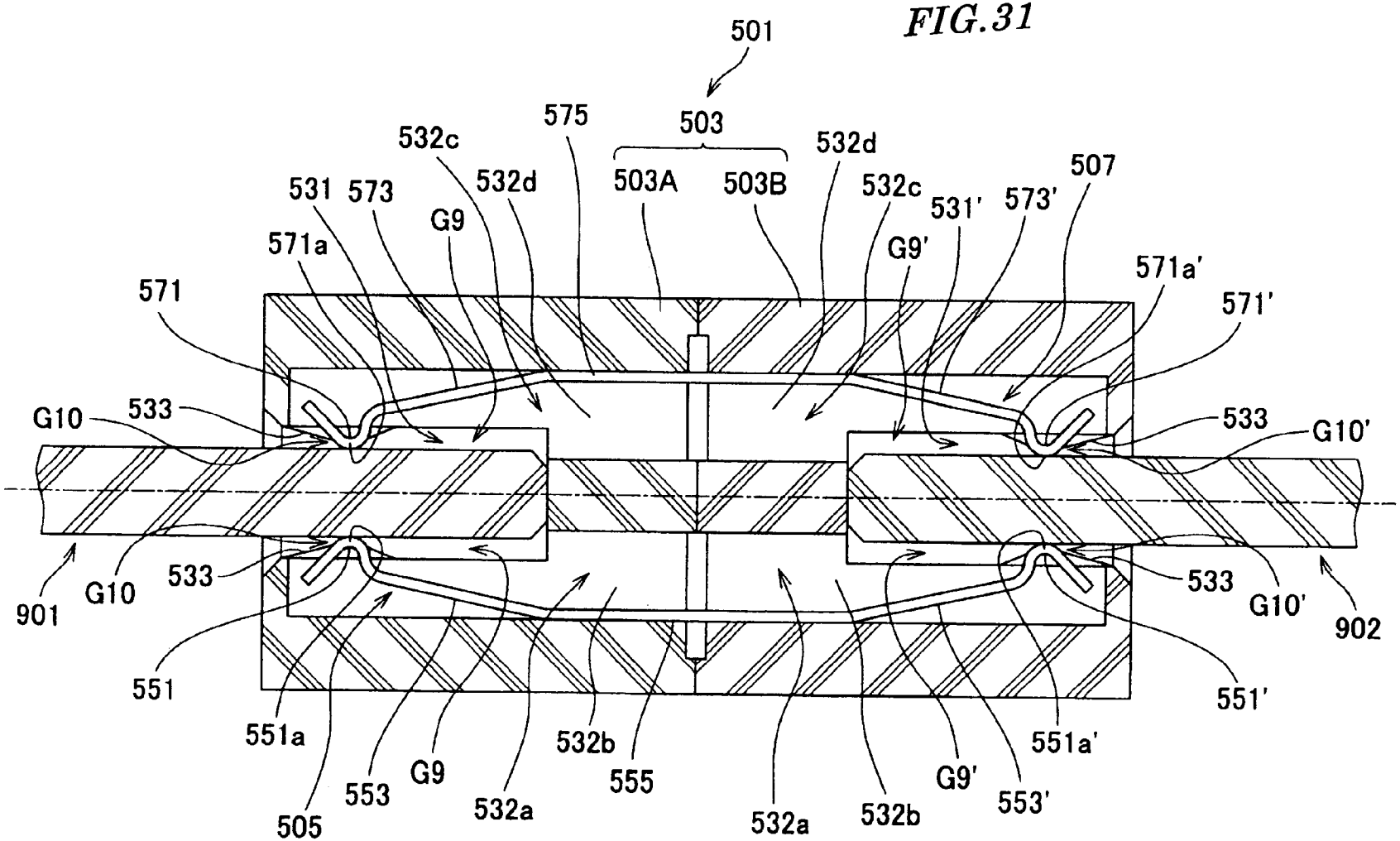
FIG. 31 is a cross-sectional view of the FIG. 30 card edge connector in a state of use.

As shown in FIGS. 30 and 31, the card edge connector (connector) 501 is comprised of a housing 503, a plurality of first contacts 505, and a plurality of second contacts 507.

The housing 503 is comprised of a first housing member 503A and a second housing member 503B. The housing 503 has a receiving portion 531 formed at one end in the direction W5 of the width thereof, and a receiving portion 531' formed at the other end in the direction W5. The receiving portion 531 is a space for receiving one end of a circuit board (mating object to be connected) 901, while the receiving portion 531' is a space for receiving one end of a circuit board (mating object to be connected) 902. Gaps G9 and G9 are each formed between two inner surfaces of the first housing member 503A, opposed to each other via the receiving portion 531, and opposite surfaces of the circuit board 901, respectively, such that the circuit board 901 received in the receiving portion 531 can move by a predetermined distance in the direction (contact direction) of contact with contact portions 551 and 571, referred to hereinafter, of the first and second contacts 505 and 507. Similarly, there are gaps G9' and G9' d between two inner surfaces of the second housing member 503B, opposed to each other via the receiving portion 531', and opposite surfaces of the circuit board 902, respectively, such that the circuit board 902 received in the receiving portion 531' can move by a predetermined distance in the direction (contact direction) of contact with contact portions 551' and 571', referred to hereinafter, of the first and second contacts 505 and 507. In the fifth embodiment, the contact direction is approximately the same as the direction H5 of the height of the housing 503.

Protruding portions (displacement-suppressing means) 533 are formed on respective two inner surfaces of the first and second housing members 503A and 503B, opposed to each other via the receiving portions 531 and 531'.

When the circuit board 901 is inserted into the receiving portion 531 of the card edge connector 501, only small gaps G10 and G10 are formed between the protruding portions 533 and opposite surfaces of the circuit board 901, respectively. The gaps G10 and G10 are narrower than the gaps G9 and G9.

Similarly, when the circuit board 902 is inserted into the receiving portion 531' of the card edge connector 501, only small gaps G10' and G10' are formed between the protruding portions 533 and opposite surfaces of the circuit board 902, respectively. The gaps G10' and G10' are narrower than the gaps G9' and G9'.

In one of two inner surfaces of the housing 503, opposed to each other via the receiving portions 531 and 531', contact accommodating portions 532*a* are formed at equally-spaced intervals along the direction L5 of the length of the housing 503, and partition walls 532*b* are interposed between adjacent ones of the contact accommodating portions 532*a*. Part of each contact accommodating portion 532*a* faces the receiving portion 531, and part thereof faces the receiving portion 531'.

In the other of the two inner surfaces of the housing 503, opposed to each other via the receiving portions 531 and 531', contact accommodating portions 532*c* are formed at equally-spaced intervals along the direction L5 of the length of the housing 503, and partition walls 532*b* are interposed between adjacent ones of the contact accommodating portions 532*c*. Part of each contact accommodating portion 532*c* faces the receiving portion 531, and part thereof faces the receiving portion 531'.

Each first contact 505 is comprised of the contact portions (first contact portions) 551 and 551', spring portions (first spring portions) 553 and 553', and a connecting portion 555. The first contacts 505 all have the same size and the same shape.

The contact portions 551 and 551' are located at respective opposite ends of the first contact 505, and are each bent into a substantially J-shape.

The spring portions 553 and 553' are connected to the contact portions 551 and 551', respectively, and linearly extend such that they are elastically deformable.

The connecting portion 555 approximately linearly extends to connect between the spring portions 553 and 553', and is held by adjacent ones of the partition walls 532*b*.

Most part of the first contact 505 is accommodated in the contact accommodating portion 532*a*. Contact points 551*a* and 551*a'* of the respective contact portions 551 and 551' protrude from the contact accommodating portion 532*a* into the receiving portions 531 and 531'.

Each second contact 507 is comprised of the contact portions (second contact portions) 571 and 571', spring portions (second spring portions) 573 and 573', and a connecting portion 575. The second contacts 507 all have the same size and the same shape. Further, the second contacts 507 has the same size and shape as those of the first contacts 505. It should be noted that the first and second contacts 505 and 507 need not have the same size and shape, and the sizes and shapes thereof may be different from each other insofar as the contact portions of the respective contacts 505 and 507 are located at the same positions.

The contact portions 571 and 571' are located at respective opposite ends of the second contact 507, and are each bent into a substantially J-shape.

The spring portions 573 and 573' are connected to the contact portions 571 and 571', respectively, and linearly extend such that they are elastically deformable.

The connecting portion 575 approximately linearly extends to connect between the spring portions 573 and 573', and is held by adjacent ones of partition walls 532*d*.

Most part of the second contact 507 is accommodated in the contact accommodating portion 532*c*. Contact points 571*a* and 571*a'* of the respective contact portions 571 and 571' protrude from the contact accommodating portion 532*c* into the receiving portions 531 and 531'.

The circuit boards 901 and 902 are connected to the card edge connector 501 from opposite sides thereof. An operation for connecting the circuit boards 901 and 902 is the same as that in the fourth embodiment, and hence description thereof is omitted.

A description will be given of another state of use of the card edge connector in FIG. 30, with reference to FIG. 32.

Figure 32:
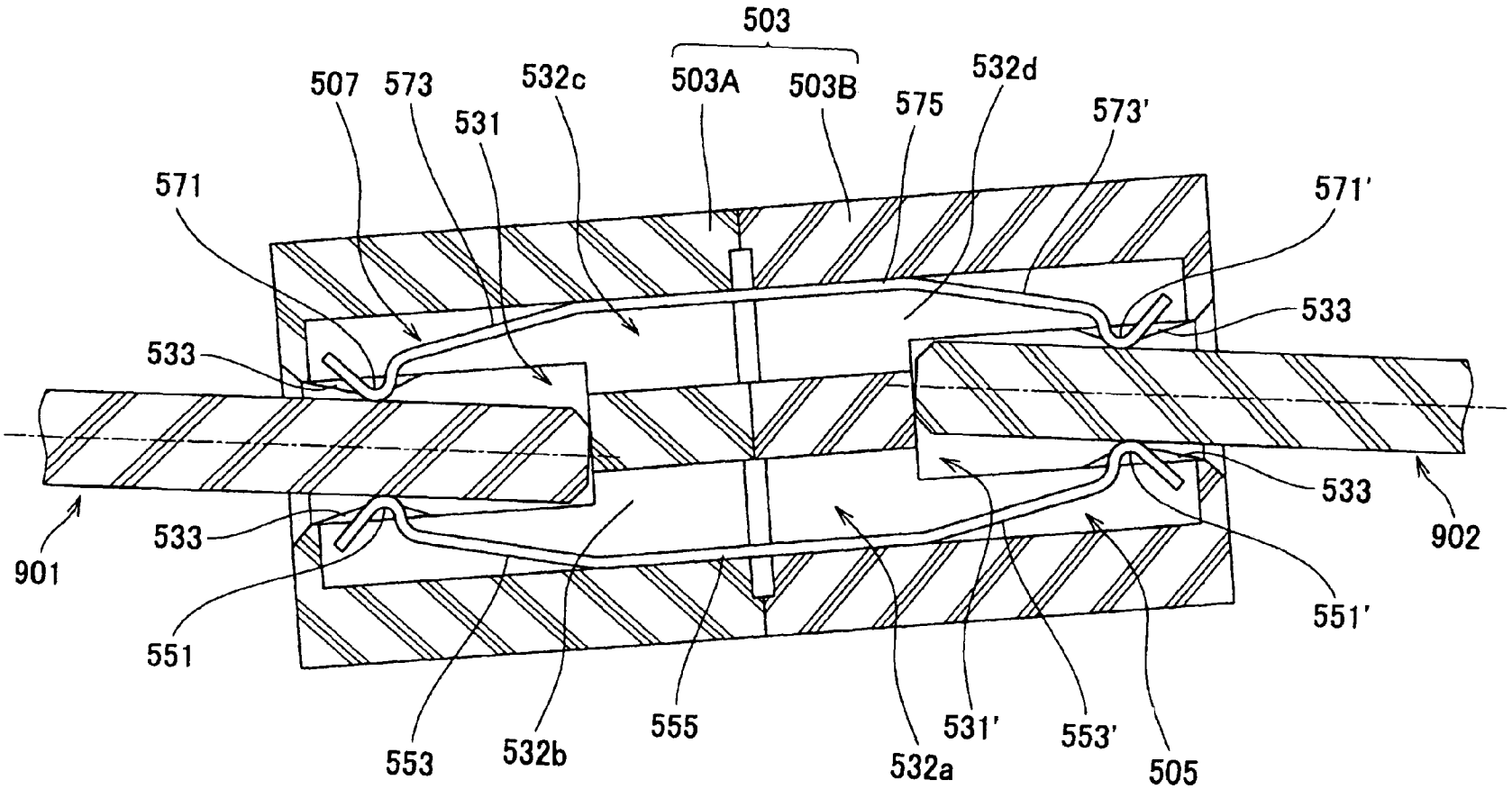
FIG. 32 is a cross-sectional view of the FIG. 30 card edge connector in another state of use.

Although in the state of use of the FIG. 31 card edge connector 501, the circuit boards 901 and 902 are arranged at the same height in the direction H5 of the height of the housing 503, in the state of use of the FIG. 32 card edge connector 501, the circuit boards 901 and 902 are displaced in the direction H5 of the height of the housing 503.

As described above, even if the circuit boards 901 and 902 are displaced in the contact direction (approximately equal to the direction H of the height of the housing 503) of the first and second contacts 505 and 507, the card edge connector 501 is capable of connecting the circuit boards 901 and 902 to each other.

According to the fifth embodiment, it is possible to obtain the same advantageous effects as provided by the fourth embodiment to absorb the displacements of the circuit boards 901 and 902 in the contact direction.

It should be noted that although in the above-described embodiments, the present invention is applied to the socket-side connector and the card edge connector, this is not limitative, but the present invention can also be applied to connectors other than the socket-side connector and the card edge connector.

Further, although in the above-described embodiments, the mating objects to be connected to the connectors are the plug-side connector 701 and the circuit boards 901 and 902, this is not limitative, but it is contemplated to use e.g. a card-type electronic device as the mating object to be connected.

It is further understood by those skilled in the art that the foregoing are the preferred embodiments of the present invention, and that various changes and modification may be made thereto without departing from the spirit and scope thereof.

What is claimed is:

1. A connector comprising:

a housing for rotatably supporting a mating object to be connected, wherein the housing includes a receiving portion for receiving said mating object to be connected;

a plurality of first contacts each of which includes a first contact portion protruding into said receiving portion such that said first contact portion is capable of being brought into contact with a first mating contact portion of the mating object to be connected, and a first spring portion that is elastically deformable and supports said first contact portion, said plurality of first contacts being arranged and held in said housing in a direction of length of said housing;

a plurality of second contacts each of which includes a second contact portion protruding into said receiving portion such that said second contact portion is capable of being brought into contact with a second mating contact portion of the mating object to be connected, and a second spring portion that is elastically deformable and supports said second contact portion, said plurality of second contacts being arranged and held in said housing in the direction of the length of said housing;

displacement-suppressing means for suppressing displacement of the mating object to be connected, in a contact direction of said first and second mating contact portions and said first and second contact portions, when the mating object to be connected has been received in said receiving portion and rotates;

wherein said housing includes a protrusion that extends in the direction of the length of said housing in a manner protruding into said receiving portion, for being fitted to the mating object to be connected, wherein said first contact portion and said first spring portion of each of said first contacts are arranged on one surface side of said protrusion, wherein said second contact portion and said second spring portion of each of said second contacts are arranged on the other surface side of said protrusion, wherein said displacement-suppressing means comprises a pair of protruding portions formed on said one surface side and said other surface side of said protrusion in a manner protruding into said receiving portion, wherein the pair of protruding portions are configured to allow said mating object to be connected to be substantially rotatable about an intermediate point of an imaginary straight line that connects a point of contact of said first contact portion and a point of contact of said second contact portion, and wherein positions of the points of contact of said first and second contact portions, and positions of said pair of protruding portions, are substantially identical in a direction in which said receiving portion receives said mating object to be connected.

2. The connector according to claim 1, wherein said plurality of first contacts and said plurality of second contacts are sandwiched by said pair of protruding portions in the direction of the length of said housing.

3. A connector comprising:

a housing for rotatably supporting a mating object to be connected, wherein the housing includes a receiving portion for receiving said mating object to be connected;

a plurality of first contacts each of which includes a first contact portion protruding into said receiving portion such that said first contact portion is capable of being brought into contact with a first mating contact portion of the mating object to be connected, and a first spring portion that is elastically deformable and supports said first contact portion, said plurality of first contacts being arranged and held in said housing in a direction of length of said housing;

a plurality of second contacts each of which includes a second contact portion protruding into said receiving portion such that said second contact portion is capable of being brought into contact with a second mating contact portion of the mating object to be connected, and a second spring portion that is elastically deformable and supports said second contact portion, said plurality of second contacts being arranged and held in said housing in the direction of the length of said housing;

displacement-suppressing means for suppressing displacement of the mating object to be connected, in a contact direction of said first and second mating contact portions and said first and second contact portions, when the mating object to be connected has been received in said receiving portion and rotates;

wherein said first contact portion and said first spring portion of each of said first contacts are arranged on one inner surface of said housing in the contact direction, wherein said second contact portion and said second spring portion of each of said second contacts are arranged on the other inner surface of said housing, opposed to the one inner surface of said housing via said receiving portion, wherein said displacement-suppressing means comprises a pair of protruding portions that are formed on both the inner surfaces of said housing in a manner protruding into said receiving portion, wherein the pair of protruding portions are configured to allow said mating object to be connected to be substantially rotatable about an intermediate point of an imaginary straight line that connects a point of contact of said first contact portion and a point of contact of said second contact portion, and wherein positions of the points of contact of said first and second contact portions, and positions of said pair of protruding portions, are substantially identical in a direction in which said receiving portion receives said mating object to be connected.

4. The connector according to claim 3, wherein said plurality of first contacts and said plurality of second contacts are sandwiched by said pair of protruding portions in the direction of the length of said housing.

5. A connector comprising:

a housing for rotatably supporting a mating object to be connected, wherein the housing includes a receiving portion for receiving said mating object to be connected;

a plurality of first contacts each of which includes a first contact portion protruding into said receiving portion such that said first contact portion is capable of being brought into contact with a first mating contact portion of the mating object to be connected, and a first spring portion that is elastically deformable and supports said first contact portion, said plurality of first contacts being arranged and held in said housing in a direction of length of said housing;

a plurality of second contacts each of which includes a second contact portion protruding into said receiving portion such that said second contact portion is capable of being brought into contact with a second mating contact portion of the mating object to be connected, and a second spring portion that is elastically deformable and supports said second contact portion, said plurality of second contacts being arranged and held in said housing in the direction of the length of said housing; and displacement-suppressing means for suppressing displacement of the mating object to be connected, in a contact direction of said first and second mating contact portions and said first and second contact portions, when the mating object to be connected has been received in said receiving portion and rotates;

wherein said first contact portion and said first spring portion of each of said first contacts are arranged on one inner surface of said housing in the contact direction, wherein said second contact portion and said second spring portion of each of said second contacts are arranged on the other inner surface of said housing, opposed to the one inner surface of said housing via said receiving portion, wherein said displacement-suppressing means comprises a metal member including a pair of protruding portions that are held in said housing and protrude into said receiving portion in a manner opposed to each other via said receiving portion in the contact direction, wherein the pair of protruding portions are configured to allow said mating object to be connected to be substantially rotatable about an intermediate point of an imaginary straight line that connects a point of contact of said first contact portion and a point of contact of said second contact portion, and wherein positions of the points of contact of said first and second contact portions, and positions of said pair of protruding portions, are substantially identical in a direction in which said receiving portion receives said mating object to be connected.

6. The connector according to claim 5, wherein said plurality of first contacts and said plurality of second contacts are sandwiched by said pair of protruding portions in the direction of the length of said housing.

* * * * *